US009126817B2

(12) United States Patent
Yamauchi

(10) Patent No.: US 9,126,817 B2
(45) Date of Patent: Sep. 8, 2015

(54) PAINT REPLENISHING APPARATUS FOR CARTRIDGE AND PAINT REPLENISHING METHOD THEREOF

(75) Inventor: Kuniharu Yamauchi, Aichi-gun (JP)

(73) Assignee: ABB K.K., Tokyo (JP)

( * ) Notice: Subject to any disclaimer, the term of this patent is extended or adjusted under 35 U.S.C. 154(b) by 254 days.

(21) Appl. No.: 13/809,212

(22) PCT Filed: Sep. 8, 2011

(86) PCT No.: PCT/JP2011/070487
§ 371 (c)(1),
(2), (4) Date: Jan. 9, 2013

(87) PCT Pub. No.: WO2012/060153
PCT Pub. Date: May 10, 2012

(65) Prior Publication Data

US 2013/0167971 A1 Jul. 4, 2013

(30) Foreign Application Priority Data

Nov. 3, 2010 (JP) ..... 2010-246928

(51) Int. Cl.
*B67D 7/02* (2010.01)
*B05B 5/04* (2006.01)
(Continued)

(52) U.S. Cl.
CPC ... *B67D 7/02* (2013.01); *B05B 5/04* (2013.01); *B05B 5/1625* (2013.01); *B05B 5/1675* (2013.01); *B05B 12/1463* (2013.01); *B05B 3/1064* (2013.01)

(58) Field of Classification Search
USPC ..... 141/1, 20.5, 85, 89, 90, 91, 92, 98, 104, 141/105, 192, 279, 284
See application file for complete search history.

(56) References Cited

U.S. PATENT DOCUMENTS 3,820,578 A * 6/1974 Staba ..... 141/190
4,745,011 A * 5/1988 Fukuta et al. ..... 427/426
(Continued)

FOREIGN PATENT DOCUMENTS

EP 2095879 A1 * 9/2009 ..... B05B 12/14
JP 2000 176328 6/2000
(Continued)

OTHER PUBLICATIONS

International Search Report Issued Oct. 25. 2011 in PCT/JP11/70487 Filed Sep. 8, 2011.

*Primary Examiner* — Timothy L Maust
*Assistant Examiner* — Andrew Schmid
(74) *Attorney, Agent, or Firm* — Oblon, McClelland, Maier & Neustadt, L.L.P.

(57) ABSTRACT

A cartridge discharges paint in a paint chamber from a feed tube by displacing a piston in a tank. A waste liquid adjusting valve located on a downstream side of a waste liquid passage on-off valve and including a throttle passage is provided in a waste liquid passage to be connected to the feed tube. This waste liquid adjusting valve is opened at the time of washing clean the paint chamber and a paint supply passage of the feed tube to widely enlarge the passage cross-sectional area of the waste liquid passage. When paint is replenished into the paint supply passage, the waste liquid adjusting valve uses the throttle passage as a flow passage to narrowly throttle the passage cross-sectional area of the waste liquid passage. The amount of discarded paint which flows out from the feed tube is thereby reduced.

11 Claims, 14 Drawing Sheets

(51) Int. Cl.

| | |
|---|---|
| ***B05B 5/16*** | (2006.01) |
| ***B05B 12/14*** | (2006.01) |
| *B05B 3/10* | (2006.01) |

(56) References Cited

U.S. PATENT DOCUMENTS

| | | | | |
|---|---|---|---|---|
| 5,309,959 | A * | 5/1994 | Shaw et al. | 141/130 |
| 5,725,161 | A * | 3/1998 | Hartle | 239/690 |
| 6,010,084 | A * | 1/2000 | Yoshida et al. | 239/703 |
| 6,164,561 | A * | 12/2000 | Yoshida et al. | 239/223 |
| 6,179,217 | B1 * | 1/2001 | Yoshida et al. | 239/7 |
| 6,612,345 | B1 * | 9/2003 | Hosoda et al. | 141/20.5 |
| 8,006,921 | B2 * | 8/2011 | Yamasaki et al. | 239/305 |
| 8,225,740 | B2 * | 7/2012 | Mitsui et al. | 118/323 |
| 2002/0158148 | A1 * | 10/2002 | Hosoda et al. | 239/305 |
| 2009/0277378 | A1 * | 11/2009 | Yamauchi | 118/300 |
| 2009/0277530 | A1 * | 11/2009 | Nomura et al. | 141/2 |
| 2010/0001099 | A1 * | 1/2010 | Onda | 239/302 |
| 2010/0243101 | A1 * | 9/2010 | Matsumoto | 141/27 |
| 2013/0167971 | A1 * | 7/2013 | Yamauchi | 141/1 |
| 2013/0320109 | A1 * | 12/2013 | Yamauchi | 239/112 |
| 2014/0151462 | A1 * | 6/2014 | Yamauchi | 239/112 |
| 2014/0166779 | A1 * | 6/2014 | Yamauchi | 239/263 |

FOREIGN PATENT DOCUMENTS

| | | |
|---|---|---|
| JP | 2000 317360 | 11/2000 |
| JP | 2006 341198 | 12/2006 |

* cited by examiner

PAINT REPLENISHING APPARATUS FOR CARTRIDGE AND PAINT REPLENISHING METHOD THEREOF

TECHNICAL FIELD

This invention relates to a paint replenishing apparatus 1 for a cartridge and a paint replenishing method thereof suitable for, for example, replenishing paint into a cartridge which is replaceably mounted on a coating apparatus.

BACKGROUND ART

Generally, a coating apparatus for coating a work piece such as the body of an automobile is required to be able to reduce the amount of paint discarded at the time of color change and to be able to deal with numerous coating colors. As a coating apparatus for dealing with these requirements, a cartridge type coating apparatus is known which is arranged such that a cartridge with paint replenished therein is replaceably mounted on a paint spraying apparatus or a coating apparatus.

The cartridge which is used in the cartridge type coating apparatus is constituted by a tank into which paint is replenished, a feed tube whose proximal end side is mounted on the tank and whose fore distal end side extends in an axial direction from the tank, a partition wall which is provided movably in the tank and partitions an interior of the tank into a paint chamber and an extruding liquid chamber, and a paint valve for opening and closing a paint supply passage in the feed tube at a fore distal end portion of the feed tube. The cartridge allows paints of a plurality of colors to be used by effecting a color change, and is arranged such that its interior is washed clean on every occasion of the color change, and a next color paint is replenished into it.

The paint replenishing apparatus for a cartridge for replenishing paint into a cartridge is largely constituted by a cartridge support member in which a feed tube insertion hole for insertion of the feed tube therethrough is provided in such a manner as to extend in the axial direction, and in which a tank support portion for supporting the tank of the cartridge at the time of the replenishment of paint is provided on a side of an insertion port of the feed tube insertion hole; a color change valve device which is provided by being connected to the cartridge support member, and which supplies a paint selected from among paints of a plurality of colors into the paint chamber of the cartridge and the paint supply passage of the feed tube at the time of the replenishment of paint, and supplies a wash fluid into the paint supply passage of the feed tube through the paint chamber at the time of washing off of remaining paint; an extruding liquid supply and discharge device which is provided by being connected to the cartridge support member, and which supplies the extruding liquid toward the extruding liquid chamber of the cartridge at the time of the washing and discharges the extruding liquid from the extruding liquid chamber at the time of the replenishment of paint; a waste liquid passage having one end side provided in communication with the feed tube insertion hole by being located on a bottom side of the feed tube insertion hole of the cartridge support member and another end side communicating with a waste liquid tank; a waste liquid passage on-off valve which is provided in the waste liquid passage to open and close the waste liquid passage; and a wash fluid supply device which is provided by being connected to the waste liquid passage and located on an outlet side of the waste liquid passage on-off valve and supplies a wash fluid for washing clean the waste liquid passage.

In the replenishment operation of replenishing paint into the cartridge by the paint replenishing apparatus for a cartridge, a used cartridge is mounted on the tank support portion of the cartridge support member, and a previous color paint remaining in the paint chamber of the cartridge is discharged to the side of the waste liquid passage connected to the discharge side of the feed tube. Next, a wash fluid is supplied from the color change valve device to wash off the previous color paint attached to the paint chamber of the cartridge and paint supply passage of the feed tube. Subsequently, a next color paint is supplied from the color change valve device, and is replenished into the paint chamber of the cartridge and the paint supply passage of the feed tube (for example, see Patent Document 1 and Patent Document 2).

PRIOR ART DOCUMENTS

Patent Documents

Patent Document 1: Japanese Patent Laid-Open No. 2000-176328 A

Patent Document 2: Japanese Patent Laid-Open No. 2006-341198 A

SUMMARY OF THE INVENTION

In the replenishment operation of replenishing paint into the cartridge, the paint needs to be reliably replenished up to the fore end of the feed tube so that the paint can be sprayed simultaneously with the start of the coating operation using the next color.

In this instance, the paint which is replenished into the paint chamber of the cartridge and the paint supply passage of the feed tube is a viscous fluid and therefore has the characteristic that the higher the temperature, the lower the viscosity, and the lower the temperature, the higher the viscosity. In an actual coating line, the temperature of paint undesirably changes easily by being affected by the operating conditions of various equipment, and fluctuations in the ambient temperature due to the atmospheric temperature and the like.

On the other hand, when paint flows through a conduit, pressure loss occurs in the conduit, and this pressure loss becomes large with an increase in the viscosity of the paint. For this reason, even if the supply pressure of paint at an inlet portion of the conduit is the same, the discharge rate of paint at an outlet portion (discharge port) of the conduit becomes greater in the case of paint with a low viscosity than paint with a high viscosity. Moreover, the pressure loss within the conduit changes depending on the cross-sectional area and the length dimension of the conduit.

Accordingly, the paint which is supplied from the paint supply source to paint valves of the color change valve device undergoes a change in its viscosity in correspondence with the fluctuation of the ambient temperature in and around the coating facility during the operation of the coating line. Hence, the discharge rate of the paint from the outlet portion of the conduit, namely, the fore end of the feed tube, also increases or decreases in correspondence with the change in viscosity of the paint.

For this reason, the pressure of supplying paint for each color is constantly set at a predetermined pressure so that the paint can be replenished up to the fore end of the feed tube in a predetermined paint replenishing time even under the state of a highest viscosity. However, even if the paint is replenished into the paint supply passage of the feed tube for a predetermined replenishing time under the predetermined supply pressure set for each color paint, when the viscosity of the paint has become low, the discharge rate of the paint from the fore end of the feed tube becomes large. As a result, there is a problem in that since a large amount of paint is discharged from the feed tube when the viscosity of the paint has become low in the case of replenishing paint into the cartridge, a large amount of paint is disadvantageously discarded wastefully from the time the trigger valve is opened until it is closed.

In view of the above-discussed problems with the conventional art, it is an object of the present invention to provide a paint replenishing apparatus for a cartridge and a paint replenishing method thereof which make it possible to reduce the amount of paint which is discharged from the feed tube and is discarded when paint is replenished into the cartridge.

(1) A paint replenishing apparatus for a cartridge according to the present invention comprises a cartridge for storing paint to be supplied to a coating apparatus, constituted by a tank, a feed tube whose proximal end side is mounted on the tank and whose fore distal end side extends in an axial direction from the tank, a partition wall which is provided movably in the tank and partitions an interior of the tank into a paint chamber into which paint is replenished and an extruding liquid chamber to and from which an extruding liquid is supplied and discharged, and a trigger valve for opening and closing a paint supply passage in the feed tube at a fore distal end portion of the feed tube; a cartridge support member in which a feed tube insertion hole for insertion of the feed tube therethrough is provided in such a manner as to extend in the axial direction, and in which a tank support portion for supporting the tank of the cartridge is provided on a side of an insertion port of the feed tube insertion hole; a color change valve device which is provided by being connected to the cartridge support member, and which supplies a paint selected from among paints of a plurality of colors into the paint chamber of the cartridge and the paint supply passage of the feed tube at a time of replenishment of paint, and supplies a wash fluid into the paint supply passage of the feed tube through the paint chamber at a time of washing off of remaining paint; an extruding liquid supply and discharge device which is provided by being connected to the cartridge support member, and which supplies the extruding liquid toward the extruding liquid chamber of the cartridge at the time of the washing and discharges the extruding liquid from the extruding liquid chamber at the time of the replenishment of paint; a waste liquid passage having one end side provided in communication with the feed tube insertion hole by being located on a bottom side of the feed tube insertion hole of the cartridge support member and another end side communicating with a waste liquid tank; a waste liquid passage on-off valve which is provided in the waste liquid passage to open and close the waste liquid passage; and a wash fluid supply device which is provided by being connected to the waste liquid passage and located on an outlet side of the waste liquid passage on-off valve and supplies a wash fluid for washing clean the waste liquid passage.

To overcome the above-described problems, the characteristic of the configuration adopted in the present invention lies in that a waste liquid adjusting valve is provided in the waste liquid passage by being located on a downstream side of the waste liquid passage on-off valve, and the waste liquid adjusting valve is arranged to widely enlarge a passage cross-sectional area of the waste liquid passage at the time of washing clean the paint chamber and the paint supply passage of the feed tube, and is arranged to narrowly throttle the passage cross-sectional area of the waste liquid passage at the time of replenishing paint into the paint supply passage of the feed tube.

With this arrangement, when washing clean the paint chamber of the cartridge and the paint supply passage of the feed tube, the waste liquid adjusting valve is opened to enlarge the passage cross-sectional area of the waste liquid passage, thereby making it possible to allow the wash fluid to be actively flowed through the waste liquid passage, so that the previous color paint remaining in the paint chamber and the paint supply passage can be effectively washed away in a short time.

Meanwhile, when a next color paint is replenished into the paint supply passage of the feed tube, the arrival time when the paint reaches the discharge port of the feed tube is set as the paint replenishing time for the feed tube in correspondence with a minimum discharge rate of the paint (a discharge rate of paint estimated to be minimal on the basis of various conditions) which is based on such conditions as the viscosity of paint to be replenished and the length dimension and inside diameter dimension (pressure loss) of the supply passage.

Accordingly, the waste liquid adjusting valve is throttled such that the passage cross-sectional area of the waste liquid passage becomes small over the entire duration of the paint replenishing time for the feed tube or prior to completion of the replenishing of paint into the paint supply passage of the feed tube. Consequently, since the passage cross-sectional area of the waste liquid passage becomes small, the amount of paint discharged from the discharge port of the feed tube is reduced.

As a result, when paint is replenished into the paint supply passage of the feed tube, even in cases where the paint replenishing time varies due to various conditions, the waste liquid adjusting valve narrowly throttles the passage cross-sectional area of the waste liquid passage, so that it is possible to reduce the amount of paint which would otherwise be discharged wastefully from the discharge port of the feed tube, thereby making it possible to decrease the amount of paint discarded when the next color paint is replenished.

(2) In this instance, according to the apparatus of the present invention, at the time of replenishing a next color paint into the paint supply passage of the feed tube, the waste liquid adjusting valve may be arranged to be opened in a state in which the passage cross-sectional area of the waste liquid passage is widely enlarged in advance, and may be arranged to narrowly throttle the passage cross-sectional area of the waste liquid passage prior to completion of replenishing.

With this arrangement, in the state in which the waste liquid adjusting valve is opened to enlarge the passage cross-sectional area, paint can be speedily replenished into the paint supply passage of the feed tube, thereby making it possible to shorten the replenishing time. Meanwhile, as the waste liquid adjusting valve decreases the passage cross-sectional area of the waste liquid passage prior to completion of replenishing, it is possible to reduce the discharge rate of paint which is discarded from the discharge port of the feed tube.

(3) In this instance, according to the apparatus of the present invention, at the time of replenishing a next color paint into the paint supply passage of the feed tube, the waste liquid adjusting valve may be arranged to narrowly throttle the passage cross-sectional area of the waste liquid passage continuously from a start to an end of replenishing.

With this arrangement, in the operation of replenishing paint into the paint supply passage of the feed tube, the passage cross-sectional area of the waste liquid passage can be constantly made small, and therefore it is possible to reduce the discharge rate of paint which is discarded from the discharge port of the feed tube.

(4) According to the apparatus of the present invention, the waste liquid adjusting valve is constituted by a valve casing having a valve seat in the course of the waste liquid passage and a valve body which is seated on and unseated from the valve seat, and the waste liquid adjusting valve is arranged to be provided with a throttle passage for allowing paint to be flowed therethrough with a small passage cross-sectional area in a closing position in which the valve body abuts against the valve seat.

With this arrangement, the waste liquid adjusting valve is able to control the valve body between two positions, namely, the opening position and the closing position, so that the mechanism can be simplified. Moreover, when the waste liquid adjusting valve is closed, the passage cross-sectional area of the waste liquid passage can be throttled by the throttle passage so as to become fixed irrespective of various conditions of the paint.

(5) According to the apparatus of the present invention, the waste liquid adjusting valve is constituted by a valve casing having a valve seat in the course of the waste liquid passage and a valve body which is seated on and unseated from the valve seat, and the valve casing is provided with a stopper for holding the valve body in a proximate position which is proximate to the valve seat to form a throttle passage between the valve seat and the valve body so as to allow the paint to flow with a small passage cross-sectional area.

With this configuration, the waste liquid adjusting valve is able to control the valve body between two positions, namely, the opening position and the proximate position, so that the mechanism can be simplified. Moreover, when the waste liquid adjusting valve is disposed in the proximate position, the passage cross-sectional area of the waste liquid passage can be throttled by the throttle passage so as to become fixed irrespective of various conditions of the paint.

(6) A paint replenishing method for a cartridge in accordance with the present invention is a paint replenishing method for a cartridge for replenishing paint to be supplied to a coating apparatus into a cartridge which is constituted by a tank into which the paint is replenished, a feed tube whose proximal end side is mounted on the tank and whose fore distal end side extends in an axial direction from the tank, a partition wall which is provided movably in the tank and partitions an interior of the tank into a paint chamber and an extruding liquid chamber, and a trigger valve for opening and closing a paint supply passage in the feed tube at a fore distal end portion of the feed tube, the paint replenishing method for a cartridge further comprising: a previous color paint discharging step of discharging a previous color paint remaining in the paint chamber of the cartridge to a side of a waste liquid passage connected to a discharge side of the feed tube; a cartridge washing step of washing off the previous color paint attached to the paint chamber of the cartridge and the paint supply passage of the feed tube; a feed tube side paint replenishing step of replenishing a next color paint in a state in which a discharge rate of the paint from the paint supply passage is decreased by narrowly regulating a passage cross-sectional area of the waste liquid passage when the next color paint is replenished into the paint supply passage of the feed tube; and a paint chamber side paint replenishing step of replenishing the next color paint into the paint chamber of the cartridge in a state in which the waste liquid passage is closed upon completion of replenishing of the next color paint into the paint supply passage of the feed tube.

With this arrangement, when paint is replenished into the cartridge, the previous color paint remaining in the paint chamber of the cartridge is discharged to the side of the waste liquid passage connected to the discharge side of the feed tube by the previous color paint discharging step and the cartridge washing step, and the previous paint attached to the paint chamber of the cartridge and the paint supply passage of the feed tube is washed off. Next, when the next color paint is replenished into the paint supply passage of the feed tube by the feed tube side paint replenishing step, the next color paint is replenished in a state in which the discharge rate of the paint from the paint supply passage is decreased by narrowly regulating the passage cross-sectional area of the waste liquid passage. After completion of this replenishing of the next color paint into the paint supply passage of the feed tube, next color paint is replenished into the paint chamber of the cartridge with the waste liquid passage closed by the paint chamber side paint replenishing step. Hence, it is possible to reduce the paint which is wastefully discharged from the discharge port of the feed tube.

(7) According to the method of the present invention, in the feed tube side paint replenishing step, the next color paint may be arranged to be replenished in a state in which the discharge rate of the paint from the paint supply passage is increased by widely regulating the passage cross-sectional area of the waste liquid passage in advance, and prior to completion of replenishing the discharge rate of the paint from the paint supply passage is decreased by narrowly regulating the passage cross-sectional area of the waste liquid passage.

With this arrangement, it is possible to reduce the replenishing time in the feed tube side paint replenishing step. Meanwhile, as the discharge rate of the paint from the paint supply passage is decreased prior to completion of replenishing by narrowly regulating the passage cross-sectional area of the waste liquid passage, it is possible to reduce the discharge rate of paint which is discarded from the discharge port of the feed tube.

(8) According to the method of the present invention, in the feed tube side paint replenishing step, the passage cross-sectional area of the waste liquid passage may be arranged to be narrowly throttled through an entire step of replenishing paint into the paint supply passage of the feed tube.

With this arrangement, in the feed tube side paint replenishing step, the passage cross-sectional area of the waste liquid passage can be constantly made small, and therefore it is possible to reliably reduce the discharge rate of paint which is discarded from the discharge port of the feed tube.

(9) According to the method of the present invention, the method further comprises a waste liquid passage washing step of washing clean the waste liquid passage while the paint chamber side paint replenishing step is being executed. According to this configuration, the paint chamber side paint replenishing step and the waste liquid passage washing step can be executed in parallel, thereby making it possible to improve the operational efficiency.

BRIEF DESCRIPTION OF THE DRAWINGS

FIG. 1 is a schematic view showing general arrangement of a paint replenishing apparatus for a cartridge in accordance with a first embodiment of the present invention illustrating together with a coating robot and the like.

MODE FOR CARRYING OUT THE INVENTION

Hereafter, a paint replenishing apparatus for a cartridge and a paint replenishing method thereof in the embodiments of the present invention will be in detail explained with reference to the accompanying drawings by taking a case in which paint is replenished into a cartridge which is replaceably mounted on a rotary atomizing head type coating apparatus as an example.

FIGS. 1 to 9 show a paint replenishing apparatus for a cartridge and a paint replenishing method thereof in accordance with a first embodiment of the present invention.

Figure 1:
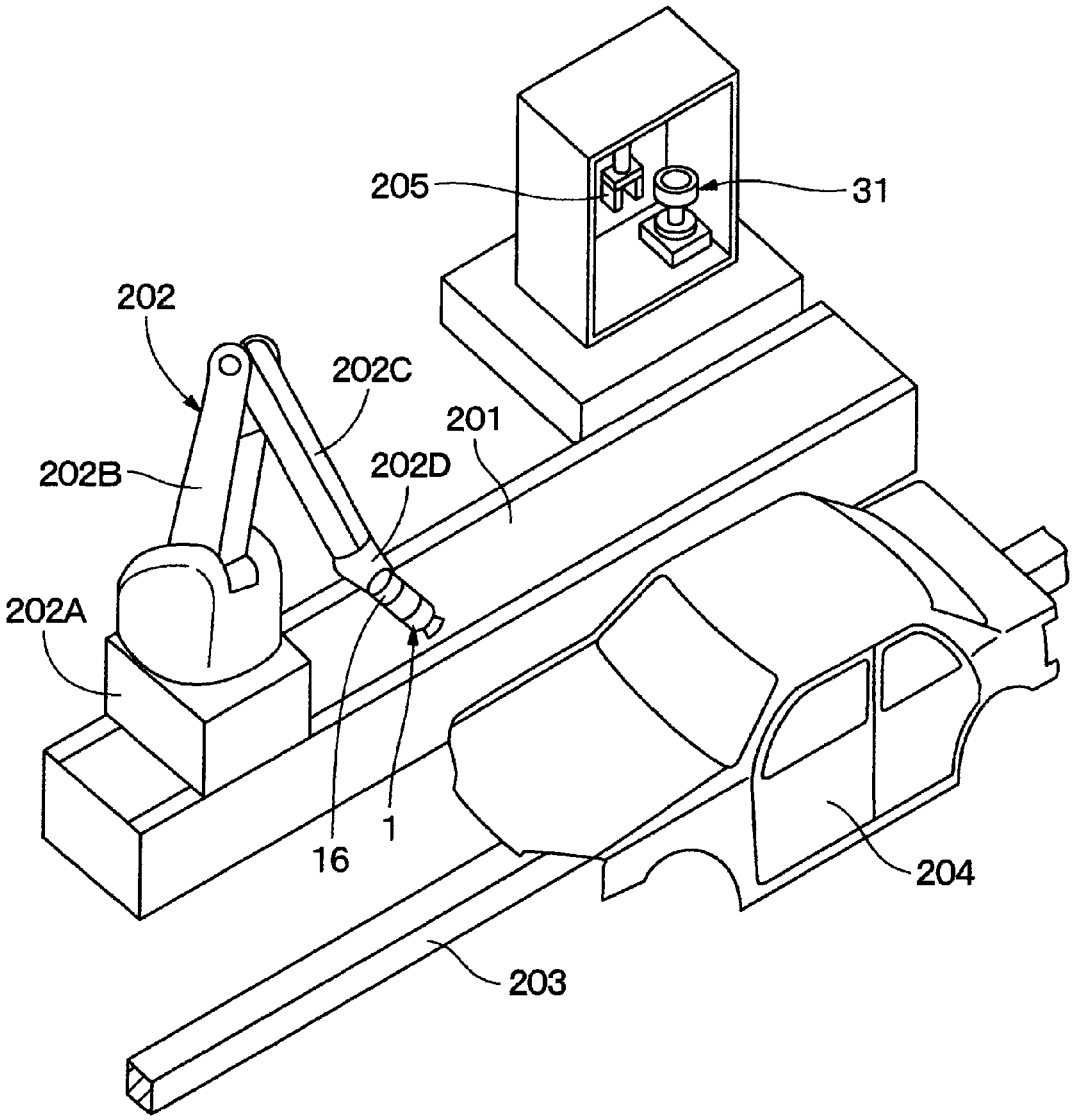

In FIG. 1, indicated at 201 is a robot traveling rail, and the rail 201 is provided along a below-described vehicle body transport line 203. A coating robot 202 is largely constituted by a pedestal 202A which is movable on the robot traveling rail 201, a vertical arm 202B which is rotatably and swingably provided on the pedestal 202A, a horizontal arm 202C which is swingably provided at a fore distal end of the vertical arm 202B, and a wrist 202D provided at a fore distal end of the horizontal arm 202C. The vehicle body transport line 203 is disposed in a coating plant, and by the vehicle body transport line 203, a vehicle body 204 of an automobile, which is a work piece, passes the front side of the coating robot 202.

Indicated at 205 is a cartridge transfer device which is arranged in the vicinity of the coating robot 202. This cartridge transfer device 205 is constituted by an articulated (multi-axis) robot or an exclusive transfer device, and is adapted to hold a cartridge 16 and transfer it between a rotary atomizing head type coating apparatus 1 and a paint replenishing apparatus for a cartridge 31, which will be described hereinafter.

Next, the rotary atomizing head type coating apparatus 1 to which the first embodiment of the present invention is applied will be explained.

Figure 2:
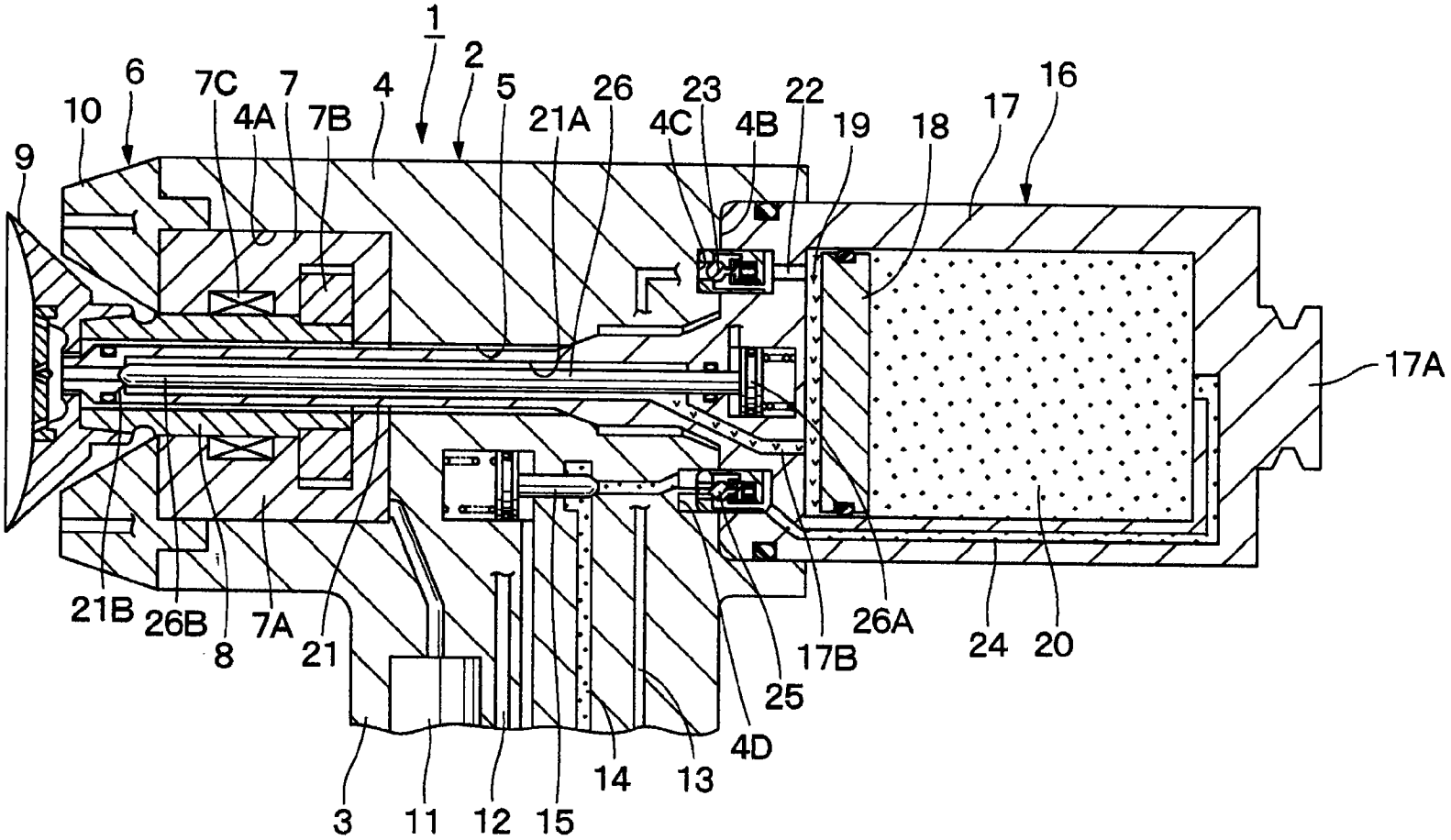
FIG. 2 is a longitudinal cross-sectional view illustrating in enlarged form a rotary atomizing head type coating apparatus shown in FIG. 1.

Designated at 1 is the rotary atomizing head type coating apparatus (hereafter referred to as the coating apparatus 1) which is provided on the wrist 202D of the coating robot 202. As shown in FIG. 2, this coating apparatus 1 is largely constituted by a housing 2, a coater unit 6, the cartridge 16, and the like which will be described hereinafter.

Indicated at 2 is the housing which is mounted at a fore distal end of the wrist 202D of the coating robot 202. This housing 2 is constituted by a neck portion 3 which is detachably mounted at the fore distal end of the wrist 202D of the coating robot 202 and a head portion 4 which is integrally formed on a fore distal end of the neck portion 3.

Here, a coater unit mounting portion 4A is formed on a front side of the head portion 4 in a recessed cylindrical shape, while a cartridge mounting portion 4B is formed on a rear side of the head portion 4 in a recessed cylindrical shape. A fitting hole 4C, to which a quick joint 23 of the below-described cartridge 16 is fitted, and a female connecting portion 4D, to which a quick joint 25 is connected, are formed in a bottom portion of the cartridge mounting portion 4B. The fitting hole 4C and the female connecting portion 4D also function to position a tank 17 of the cartridge 16 in a circumferential direction at the time of mounting the tank 17 to the cartridge mounting portion 4B.

Indicated at 5 is a feed tube insertion hole which is provided in a central portion of the head portion 4 in such a manner as to extend in an axial direction. This feed tube insertion hole 5 is for allowing a feed tube 21 of the below-described cartridge 16 to be inserted therein. The feed tube insertion hole 5 is formed in the axial direction in such a manner as to extend through the coater unit mounting portion 4A of the head portion 4 and penetrate the interior of a rotational shaft 8 of a below-described air motor 7.

Designated at 6 is the coater unit which is mounted on the coater unit mounting portion 4A of the head portion 4. The coater unit 6 is constituted by an air motor 7 comprising a motor case 7A, an air turbine 7B, and an air bearing 7C; the rotational shaft 8 supported rotatably by the air bearing 7C in a state in which the air turbine 7B is mounted on its proximal end portion; a rotary atomizing head 9 which is mounted at a fore distal end of the rotational shaft 8 and is adapted to centrifugally atomize supplied paint by being rotated by the air motor 7 so as to spray the atomized paint toward the work piece; and a shaping air ring 10 provided on the front end side of the air motor 7. This shaping air ring 10 is adapted to spurt out shaping air toward a releasing edge of the rotary atomizing head 9 so as to effect the pattern shaping of paint particles released from the rotary atomizing head 9.

A high voltage generator 11 is provided in the neck portion 3 of the housing 2. This high voltage generator 11 is constituted by, for example, a Cockcroft circuit and is adapted to boost a voltage supplied from a power supply device (not shown) from −60 to −120 kV. The output side of the high voltage generator 11 is electrically connected to, for example, the air motor 7, whereby the high voltage generator 11 applies a high voltage to the rotary atomizing head 9 through the rotational shaft 8 so as to allow the paint which is supplied to the rotary atomizing head 9 to be directly charged electrostatically.

A plurality of air passages 12 and 13 are provided in the neck portion 3 of the housing 2 and are connected to a control air source (not shown). These air passages 12 and 13 are for supplying such as turbine air for controlling the air motor 7, bearing air, brake air, shaping air for forming the spray pattern of paint, and pressurized air for the opening and closing operation of valve bodies of an extruding liquid valve 15 and a trigger valve 26. In the first embodiment, however, only two air passages 12 and 13 are typically illustrated.

A housing side extruding liquid passage 14 is provided in the housing 2. This extruding liquid passage 14 has one end connected to a extruding liquid supplying device (not shown) and the other end open to a bottom portion of the female connecting portion 4D of the cartridge mounting portion 4B formed in the head portion 4.

Furthermore, the extruding liquid valve 15 is provided in the head portion 4 of the housing 2. This extruding liquid valve 15 is normally in a closed state to shut off between the extruding liquid passage 14 and an extruding liquid chamber 20 of the cartridge 16. On the other hand, the extruding liquid valve 15, when opened, allows the circulation of an extruding liquid to and from the extruding liquid chamber 20 to thereby effect the supply and discharge of the extruding liquid.

Next, the configuration of the cartridge 16 which is used in the first embodiment of the present invention will be explained.

Figure 3:
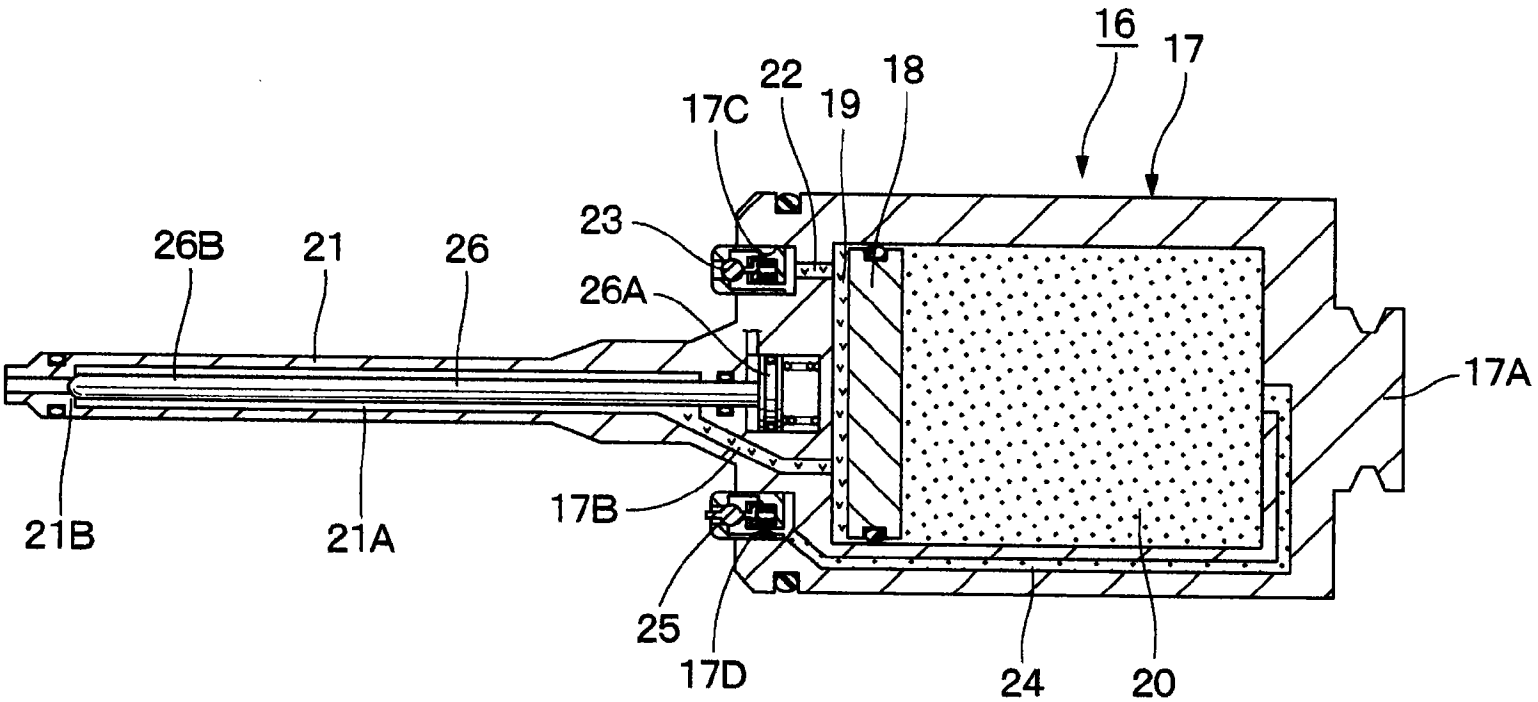
FIG. 3 is a longitudinal cross-sectional view illustrating a cartridge, shown in FIG. 2, as a single unit.

Designated at 16 is the cartridge which is detachably mounted on the cartridge mounting portion 4B of the head portion 4, and the cartridge 16 is mounted on and dismounted from a cartridge support member 32 of the below-described paint replenishing apparatus for a cartridge 31. As shown in FIG. 3, the cartridge 16 is constituted by such as the tank 17, a piston 18, and the feed tube 21 which will be described hereinafter.

The tank 17 of the cartridge 16 is formed as a cylindrical container with both axial ends blocked. The piston 18 which forms a movable partition wall is insertingly fitted in this tank 17 so as to be axially displaceable, and the piston 18 partitions the interior of the tank 17 into a front side paint chamber 19 and the rear side extruding liquid chamber 20.

An extruding liquid passage 24 is formed on the rear side of the tank 17 in such a manner as to be open to the extruding liquid chamber 20, and a grip projection 17A for gripping the cartridge 16 is provided at a rear end portion of the tank 17. Meanwhile, a paint passage 17B for allowing a paint supply passage 21A of the below-described feed tube 21 to communicate with the paint chamber 19 is provided on the front side of the tank 17. Further, a joint mounting hole 17C for mounting the below-described quick joint 23 and a joint mounting hole 17D for mounting a quick joint 25 are provided on the front side of the tank 17.

The feed tube 21 is provided at a central position on the front side of the tank 17 in such a manner as to extend in the axial direction. The distal end side of this feed tube 21 extends through the feed tube insertion hole 5, and its fore distal end portion is open toward the rotary atomizing head 9. The paint supply passage 21A communicating with the paint chamber 19 of the tank 17 through the paint passage 17B is formed in the feed tube 21. Further, a valve seat portion 21B formed by reducing the diameter of the aforementioned paint supply passage 21A is provided on the distal end side of the feed tube 21.

Figure 4:
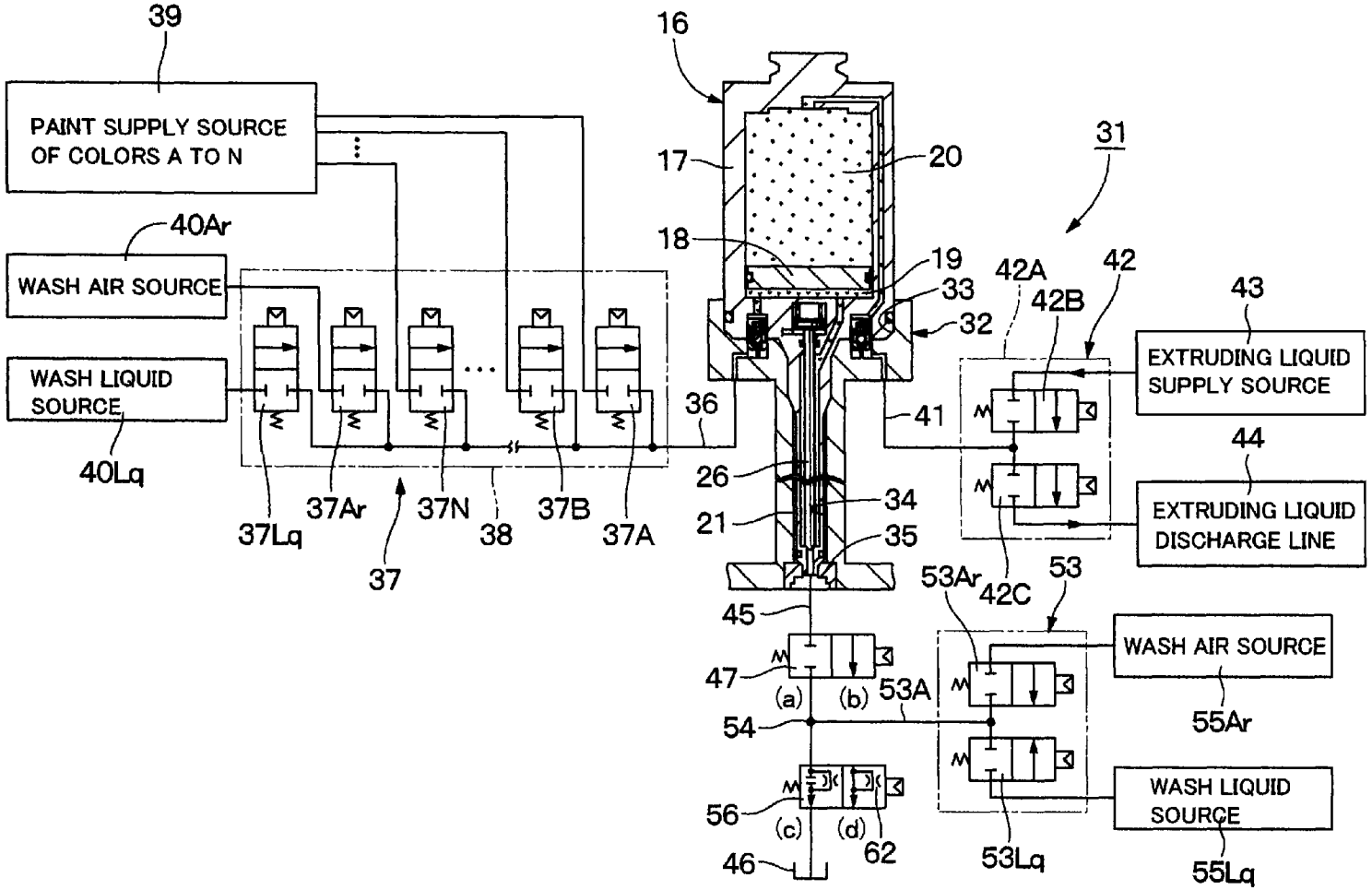
FIG. 4 is a circuit diagram illustrating the paint replenishing apparatus for a cartridge in accordance with a first embodiment.
Figure 5:
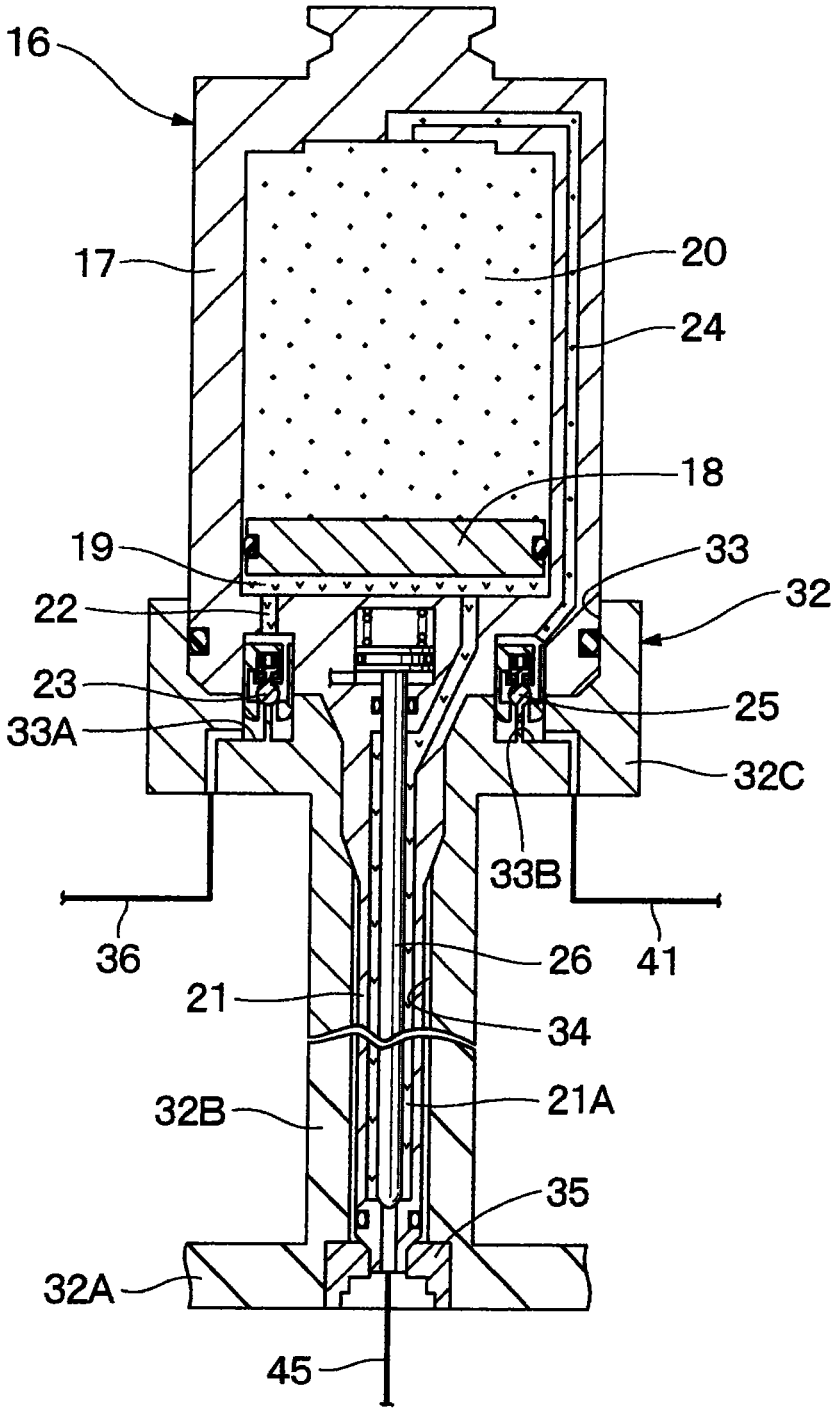
FIG. 5 is a longitudinal cross-sectional view illustrating in enlarged form a cartridge support member shown in FIG. 4.

A cartridge side paint passage 22 is provided on the front side of the tank 17 in such a manner as to communicate with a front portion of the paint chamber 19. As shown in FIGS. 4 and 5, this cartridge side paint passage 22 is provided radially outwardly of the feed tube 21 and communicates with the front portion of the paint chamber 19. Meanwhile, when the cartridge 16 is mounted on the below-described cartridge support member 32, the cartridge side paint passage 22 is able to communicate with a paint line 36 on the cartridge support member 32 side.

The quick joint 23 with a check valve is provided in the joint mounting hole 17C of the tank 17 by being located at an open end of the cartridge side paint passage 22. When the tank 17 is mounted on a tank support portion 33 of the cartridge support member 32, this quick joint 23 opens its valve to allow the circulation of paint, and when the tank 17 is removed from the tank support portion 33, the quick joint 23 closes its valve to prevent the paint from flowing out from the cartridge side paint passage 22.

The cartridge side extruding liquid passage 24 is provided in a peripheral wall of the tank 17 in such a manner as to communicate with the extruding liquid chamber 20. As shown in FIG. 2, when the tank 17 of the cartridge 16 is insertingly fitted in the cartridge mounting portion 4B of the head portion 4, this extruding liquid passage 24 communicates with the housing side extruding liquid passage 14. Meanwhile, as shown in FIG. 5, when the tank 17 of the cartridge 16 is insertingly fitted in the tank support portion 33 of the cartridge support member 32, the extruding liquid passage 24 communicates with an extruding liquid line 41.

The quick joint 25 with a check valve is provided in the joint mounting hole 17D of the tank 17 by being located at an open end of the cartridge side extruding liquid passage 24. This quick joint 15 functions substantially in the same way as the aforementioned quick joint 23, and when the tank 17 is mounted on the cartridge mounting portion 4B of the head portion 4 or the tank support portion 33 of the cartridge support member 32, this quick joint 25 opens its valve to allow the circulation of the extruding liquid, and when the tank 17 is removed from the cartridge mounting portion 4B or the tank support portion 33, the quick joint 25 closes its valve to prevent the extruding liquid from flowing out from the cartridge side extruding liquid passage 24.

Further, the trigger valve 26 is provided on a front side portion of the tank 17. This trigger valve 26 supplies or stops supplying the paint from the feed tube 21 toward the rotary atomizing head 9. Here, this trigger valve 26 is a two-way and two-position normally closed air-driven type on-off valve which is largely constituted by an axially displaceable piston 26A and a valve body 26B whose valve stem extends from the piston 26A through the paint supply passage 21A of the feed tube 21 and whose distal end is seated on and unseated from the valve seat portion 21B.

Next, the paint replenishing apparatus for a cartridge 31 which is used in the first embodiment will be explained.

Designated at 31 is the paint replenishing apparatus for a cartridge in accordance with the first embodiment which is provided in the vicinity of the operational range of the coating robot 202 (see FIG. 1). This paint replenishing apparatus for a cartridge 31 is for washing clean the used cartridge 16 which was used in coating and for replenishing paint of a next color. Here, the paint replenishing apparatus for a cartridge 31 is largely constituted by the cartridge support member 32, a color change valve device 37, an extruding liquid supply and discharge device 42, a waste liquid passage 45, a waste liquid passage on-off valve 47, a wash fluid supply device 53, and a waste liquid adjusting valve 56.

Designated at 32 is the cartridge support member of the paint replenishing apparatus for a cartridge 31. This cartridge support member 32 is constituted by a pedestal portion 32A, a column portion 32B extending vertically upward from the pedestal portion 32A, and a seat portion 32C which is provided by widening the upper side of the column portion 32B.

The tank support portion 33 is formed on the upper side of the seat portion 32C. This tank support portion 33 is for mounting the tank 17 of the cartridge 16 thereon. Formed separately on the bottom portion of the tank support portion 33 are a female coupling portion 33A to which the quick joint 23 of the cartridge 16 is coupled and a female coupling portion 33B to which the quick joint 25 is coupled.

Indicated at 34 is a feed tube insertion hole which is provided in such a manner as to extend vertically through a central portion of the cartridge support member 32. This feed tube insertion hole 34 is for the feed tube 21 of the cartridge 16 to be inserted therethrough when the tank 17 of the cartridge 16 is mounted to the tank support portion 33. For this reason, an upper end of the feed tube insertion hole 34 serves as an insertion port for the feed tube 21.

A feed tube abutting member 35 is provided at a lower end (bottom side) of the feed tube insertion hole 34. This feed tube abutting member 35 is formed as a cylindrical body mounted in the center of the pedestal portion 32A of the cartridge support member 32. The feed tube abutting member 35 is adapted to connect the paint supply passage 21A of the feed tube 21 and the below-described waste liquid passage 45 as the fore distal end of the feed tube 21 air-tightly abuts against its inner peripheral side.

The paint line 36 is provided by being coupled to the seat portion 32C of the cartridge support member 32. As for this paint line 36, its one end side which is an upstream side communicates with a paint discharge port of the below-described color change valve device 37, and its other end side communicates with the female coupling portion 33A of the tank support portion 33.

Indicated at 37 is the color change valve device which is provided by being coupled to the cartridge support member 32 through the paint line 36. At the time of replenishing of paint, a paint to be replenished into the cartridge 16 is selected from among paints of a plurality of colors, and the color change valve device 37 is used to supply the selected paint into the paint chamber 19 of the cartridge 16 and into the paint supply passage 21A of the feed tube 21 through the paint line 36. At the time of washing off the paint remaining in the paint chamber 19 and the paint supply passage 21A, this color change valve device 37 supplies a wash liquid and wash air, which serve as wash fluids, into the paint chamber 19 and the paint supply passage 21A of the feed tube 21.

The color change valve device 37 is a device for controlling selective supply of paint and the wash fluids to the cartridge 16. This color change valve device 37 is constituted by paint valves 37A, 37B, . . . , and 37N for colors A, B, . . . , and N incorporated in a valve casing 38, a wash air valve 37Ar, and a wash liquid valve 37Lq. The paint valves 37A, 37B, . . . , and 37N for colors A, B, . . . , and N are respectively connected to a paint supply source 39 for supplying paints of the colors A, B, . . . , and N, and are connected to the paint line 36. The paint valves 37A, 37B, . . . , and 37N are opened at the time of replenishing the cartridge 16 with paint to supply the respective paint of the colors A, B, . . . , and N from the paint supply source 39.

The wash air valve 37Ar is connected to a wash air source 40Ar and the paint line 36, and the wash liquid valve 37Lq is connected to a wash liquid source 40Lq and the paint line 36. At the time of washing the cartridge 16, the wash air valve 37Ar and the wash liquid valve 37Lq are alternately opened and closed to supply the wash air and the wash liquid.

Here, two-way and two-position air-driven type on-off valves are adopted as the valves 37A, 37B through 37N, 37Ar, and 37Lq in substantially the same way as the below-described waste liquid passage on-off valve 47, and are configured to be normally closed and are opened upon supply of pressurized air thereto.

Meanwhile, the extruding liquid line 41 is provided by being coupled to the seat portion 32C of the cartridge support member 32. As for this extruding liquid line 41, its one end side communicates with the below-described extruding liquid supply and discharge device 42, and its other end side communicates with the female coupling portion 33B of the tank support portion 33.

Indicated at 42 is the extruding liquid supply and discharge device which is provided by being coupled to the cartridge support member 32 through the extruding liquid line 41. At the time of washing off a previous color paint used in the previous coating operation, this extruding liquid supply and discharge device 42 supplies an extruding liquid from an extruding liquid supply source 43 toward the extruding liquid chamber 20 of the cartridge 16. Meanwhile, at the time of replenishing the paint chamber 19 with paint, the extruding liquid supply and discharge device 42 discharges the extruding liquid from the extruding liquid chamber 20 toward an extruding liquid discharge line 44.

The extruding liquid supply and discharge device 42 is a device for supplying and discharging the extruding liquid to and from the extruding liquid chamber 20 of the cartridge 16. For this reason, the extruding liquid supply and discharge device 42 is constituted by an extruding liquid supply valve 42B and an extruding liquid discharge valve 42C which are incorporated in a valve casing 42A. The extruding liquid supply valve 42B is connected to both the extruding liquid supply source 43 and the extruding liquid line 41. The extruding liquid supply valve 42B supplies the extruding liquid from the extruding liquid supply source 43 toward the extruding liquid chamber 20. On the other hand, the extruding liquid discharge valve 42C is connected to both the extruding liquid discharge line 44 and the extruding liquid line 41. When paint is replenished into the paint chamber 19, the extruding liquid discharge valve 42C is opened to allow the extruding liquid in the extruding liquid chamber 20 to flow out to the extruding liquid discharge line 44.

Here, two-way and two-position air-driven type on-off valves are adopted as the extruding liquid supply valve 42B and the extruding liquid discharge valve 42C in substantially the same way as the below-described waste liquid passage on-off valve 47, and are configured to be normally closed and are opened upon supply of pressurized air thereto.

Designated at 45 is the waste liquid passage which is provided by being coupled to a bottom portion side (lower end) of the feed tube insertion hole 34 of the cartridge support member 32. As for the waste liquid passage 45, its inlet port communicates with the paint supply passage 21A of the feed tube 21 in a state in which the fore distal end of the feed tube 21 abuts against the feed tube abutting member 35. Meanwhile, an outlet port of the waste liquid passage 45 communicates with a waste liquid tank 46.

Figure 6:
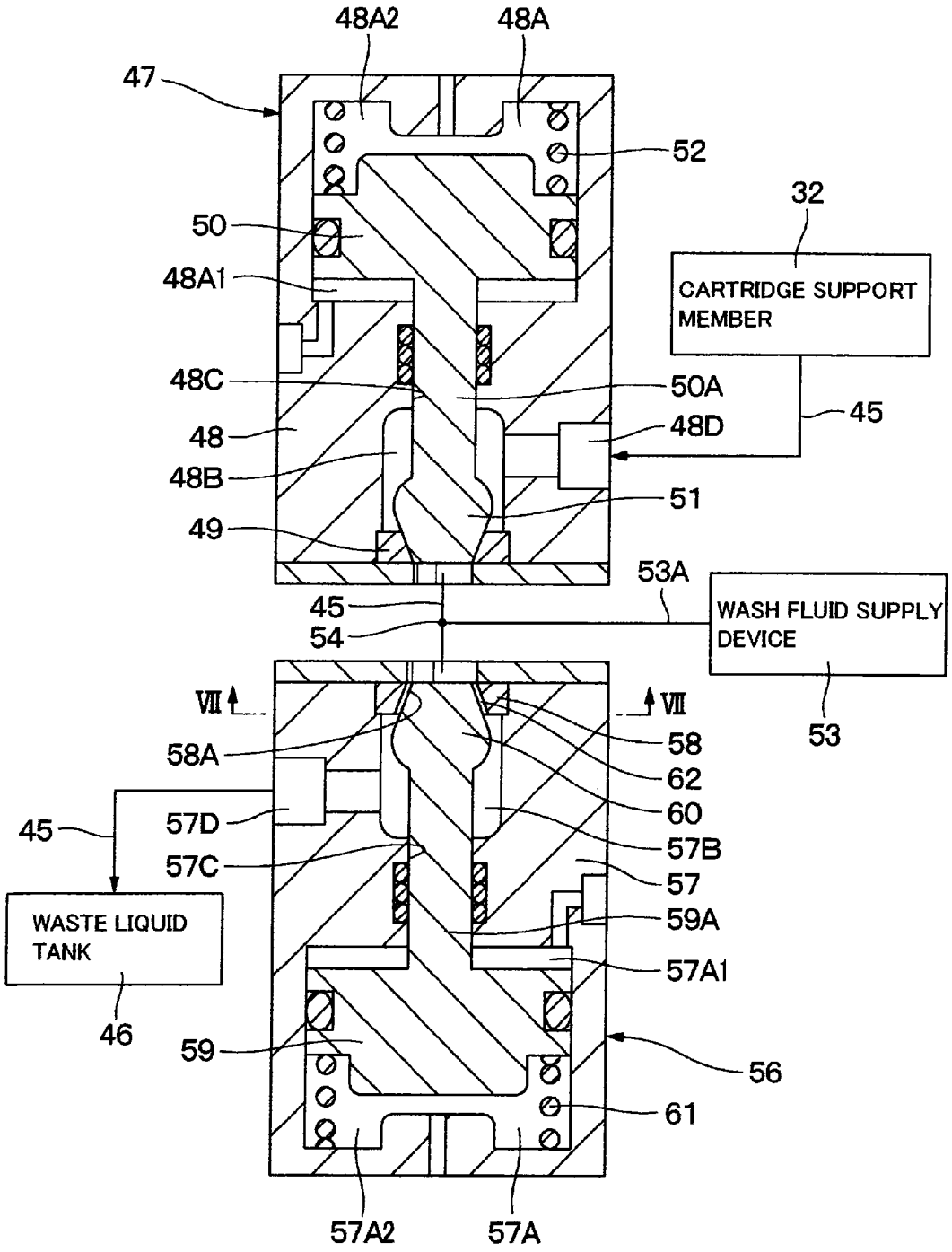
FIG. 6 is a longitudinal cross-sectional view illustrating a waste liquid passage on-off valve and a waste liquid adjusting valve, shown in FIG. 4, both in a closed state.

Designated at 47 is the waste liquid passage on-off valve which is provided in the waste liquid passage 45 to open and close the waste liquid passage 45. As shown in FIG. 6, this waste liquid passage on-off valve 47 is constituted by a valve casing 48, a valve seat 49, a piston 50, a valve body 51, a valve spring 52, and the like. The waste liquid passage on-off valve 47 is a two-way and two-position air-driven type on-off valve which is normally closed by pressing the piston 50 by the urging force of the valve spring 52, and is opened against the urging force of the valve spring 52 upon supply of pressurized air to a pressure receiving chamber 48A1 of a piston chamber 48A, as mentioned hereinafter.

The valve casing 48 forms the outer shape of the waste liquid passage on-off valve 47. Namely, this valve casing 48 is formed by the piston chamber 48A, a valve chamber 48B, a valve stem insertion hole 48C allowing the two chambers 48A and 48B to communicate with each other, an inlet port 48D, and the like. The inlet port 48D is connected to the valve chamber 48B and communicates with the cartridge support member 32 through the waste liquid passage 45. Meanwhile, the valve seat 49 forming a part of the valve chamber 48B is provided in the valve casing 48 at a position opposing the below-described valve body 51, and the valve chamber 48B communicates with a connecting point 54 of the waste liquid passage 45 by way of the valve seat 49. The piston 50 is insertingly fitted slidably in the piston chamber 48A of the valve casing 48, and partitions the piston chamber 48A into the pressure receiving chamber 48A1 and a spring chamber 48A2. A valve stem 50A is provided at an axially central position of the piston 50, the valve stem 50A is slidably inserted in the valve stem insertion hole 48C and extends to the valve chamber 48B, and the valve body 51 is provided at a fore distal end of the valve stem 50A.

As the piston 50 is pressed by the valve spring 52 provided in the spring chamber 48A2 of the piston chamber 48A, the valve body 51 is normally closed by being seated on the valve seat 49 to shut off the waste liquid passage 45. Namely, the waste liquid passage on-off valve 47 is in a closing position (a) in FIG. 4. Meanwhile, when pressurized air is supplied into the pressure receiving chamber 48A1 of the piston chamber 48A to displace the piston 50 in the opposite direction in opposition to the valve spring 52, the waste liquid passage on-off valve 47 is able to open the valve body 51 to allow the waste liquid passage 45 to communicate. Namely, the waste liquid passage on-off valve 47 is in an opening position (b) in FIG. 4.

Indicated at 53 is the wash fluid supply device which is connected to the waste liquid passage 45 by being located on the downstream side of the waste liquid passage on-off valve 47. This wash fluid supply device 53 is constituted by a wash air valve 53Ar and a wash liquid valve 53Lq. The wash fluid supply device 53 is a device for supplying the wash air and the wash liquid to the waste liquid passage 45 so as to wash off the paint adhering to the waste liquid passage 45 at the time of replenishing the cartridge 16 with paint and at the time of discharging the paint remaining in the cartridge 16. The wash fluid supply device 53 is located in the waste liquid passage 45 between the waste liquid passage on-off valve 47 and the below-described waste liquid adjusting valve 56, and is connected to the connecting point 54 of the waste liquid passage 45 through the supply line 53A and to a wash air source 55Ar and a wash liquid source 55Lq, respectively.

Namely, the wash air valve 53Ar is connected to the wash air source 55Ar and is also connected to the supply line 53A to supply the wash air from the wash air source 55Ar to the waste liquid passage 45. The wash liquid valve 53Lq is connected to the wash liquid source 55Lq and is also connected to the supply line 53A to supply the wash liquid from the wash liquid source 55Lq to the waste liquid passage 45. At the time of washing off the waste liquid passage 45, the wash air valve 53Ar and the wash liquid valve 53Lq are alternately opened and closed to wash off the paint remaining in the waste liquid passage 45 by allowing the wash air and the wash liquid to flow out.

Here, two-way and two-position air-driven type on-off valves are adopted as the wash air valve 53Ar and the wash liquid valve 53Lq in the same way as the above-described waste liquid passage on-off valve 47, and are configured to be normally closed and are opened upon supply of pressurized air thereto.

Next, the configuration of the waste liquid adjusting valve 56 used in the first embodiment will be explained.

Figure 8:
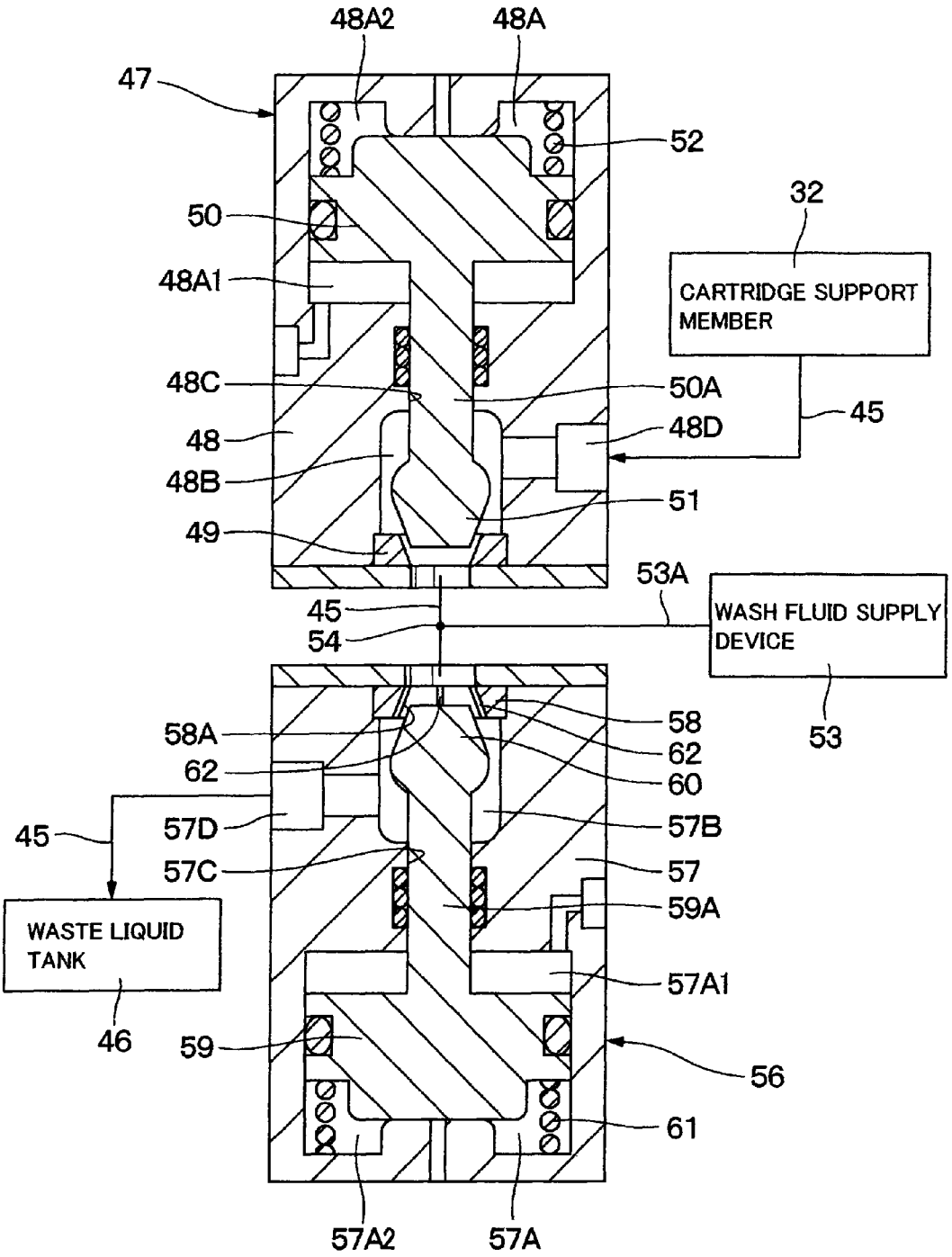
FIG. 8 is a longitudinal cross-sectional view illustrating the waste liquid passage on-off valve and the waste liquid adjusting valve, shown in FIG. 6, both in an opened state.

Designated at 56 is the waste liquid adjusting valve which is provided in the waste liquid passage 45, and the waste liquid adjusting valve 56 is provided on the downstream side of the waste liquid passage on-off valve 47, namely, on the downstream side of the connecting point 54 between the waste liquid passage 45 and the wash fluid supply device 53. As shown in FIG. 8, at the time of washing clean the paint chamber 19 of the cartridge 16 and the paint supply passage 21A of the feed tube 21, this waste liquid adjusting valve 56 is opened to widely enlarge the passage cross-sectional area of the waste liquid passage 45. Meanwhile, as shown in FIG. 6, at the time of replenishing the paint supply passage 21A of the feed tube 21 with paint, the waste liquid adjusting valve 56 is closed prior to completion of replenishing to narrowly throttle the passage cross-sectional area of the waste liquid passage 45.

The waste liquid adjusting valve 56 is formed as a two-way and two-position air-driven type on-off valve in substantially the same way as the above-described waste liquid passage on-off valve 47, and is constituted by such as a valve casing 57, a valve seat 58, a piston 59, a valve body 60, and a valve spring 61 which will be described hereinafter. However, the waste liquid adjusting valve 56 differs from the waste liquid passage on-off valve 47 in that the valve seat 58 is provided with throttle passages 62.

The valve casing 57 forms the outer shape of the waste liquid adjusting valve 56. Namely, this valve casing 57 is formed as a hollow casing by a piston chamber 57A, a valve chamber 57B, a valve stem insertion hole 57C allowing the two chambers 57A and 57B to communicate with each other, an outlet port 57D, and the like. The valve casing 57 is provided with the outlet port 57D at a position corresponding to the valve chamber 57B, and the outlet port 57D communicates with the waste liquid tank 46 through the waste liquid passage 45.

The valve seat 58 is provided by being located at an open end of the valve chamber 57B opposing the below-described valve body 60 so as to form a part of the valve casing 57, and the valve seat 58 forms a part of the valve casing 57. Here, the valve seat 58 is formed as a hollow cylindrical body having a conical inner peripheral surface 58A opposing the valve body 60, and the valve body 60 is adapted to be seated on and unseated from the inner peripheral surface 58A of the valve seat 58. Further, the below-described throttle passages 62 are provided on the inner peripheral surface 58A of the valve seat 58 in such a manner as to extend in the axial direction.

The piston 59 is insertingly fitted in the piston chamber 57A of the valve casing 57 slidably in the axial direction. This piston 59 partitions the piston chamber 57A into a pressure receiving chamber 57A1 and a spring chamber 57A2. Further, a valve stem 59A is provided at an axially central position of the piston 59, the valve stem 59A is slidably inserted in the valve stem insertion hole 57C and extends to the valve chamber 57B, and the below-described valve body 60 is provided at a distal end of the valve stem 59A.

The valve body 60 is provided at the distal end of the valve stem 59A of the piston 59 by being located in the valve chamber 57B of the valve casing 57. This valve body 60 is formed in a conical trapezoidal shape whose diameter becomes smaller toward its distal end, and is adapted to be brought into close contact with the inner peripheral surface 58A of the valve seat 58. Here, as the piston 59 is displaced in axial directions, the valve body 60 is unseated from and seated on the inner peripheral surface 58A of the valve seat 58.

The valve spring 61 is provided in the spring chamber 57A2 of the piston chamber 57A. This valve spring 61 urges the valve body 60 in the valve closing direction by means of the piston 59. Hence, the waste liquid adjusting valve 56 is configured as a normally closed valve.

Figure 7:
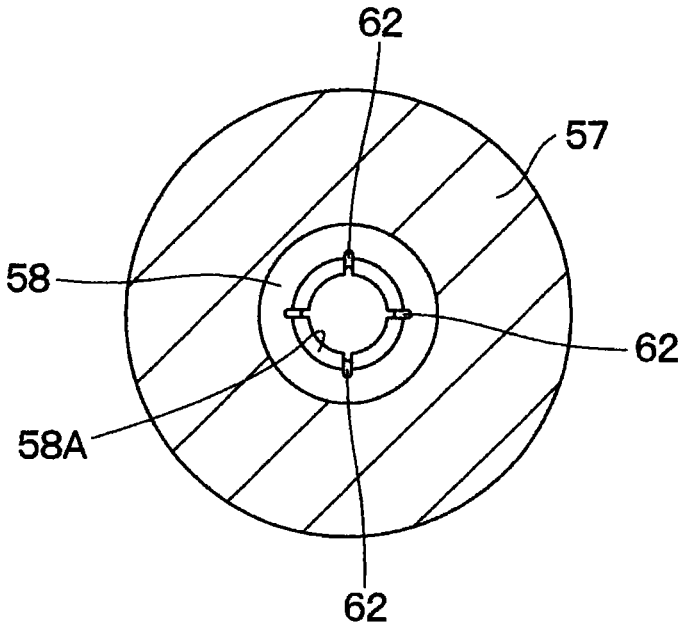
FIG. 7 is a transverse cross-sectional view taken from the direction of arrows VII-VII in FIG. 6.

Indicated at 62 are the throttle passages in accordance with the first embodiment which are provided on the valve seat 58. These throttle passages 62 allow a small amount of paint to flow even in the valve closed state in which the valve body 60 is in close contact with the inner peripheral surface 58A of the valve seat 58. Namely, as shown in FIGS. 7 and 8, the throttle passages 62 are formed as recessed grooves located at a plurality of circumferential positions, for example located at four positions, and formed by axially notching the inner peripheral surface 58A of the valve seat 58.

As shown in FIG. 6, in a state in which pressurized air for driving is stopped, the waste liquid adjusting valve 56 is closed by pressing the valve body 60 against the valve seat 58 by the urging force of the valve spring 61. Namely, the waste liquid adjusting valve 56 is in a closing position (c) in FIG. 4. Accordingly, the waste liquid adjusting valve 56 is able to allow a small amount of paint to flow by narrowly regulating the passage cross-sectional area of the waste liquid passage 45 by the throttle passages 62 provided on the valve seat 58.

Meanwhile, as shown in FIG. 8, when pressurized air is supplied into the pressure receiving chamber 57A1 of the piston chamber 57A of the valve casing 57 to displace the piston 59 in opposition to the valve spring 61, the waste liquid adjusting valve 56 is opened by causing the valve body 60 to be unseated from the valve seat 58. Namely, the waste liquid adjusting valve 56 is in an opening position (d) in FIG. 4. In consequence, since the waste liquid adjusting valve 56 enlarges the passage cross-sectional area of the waste liquid passage 45, the waste liquid adjusting valve 56 allows greater amounts of paint and wash fluids to flow than when the waste liquid adjusting valve 56 is closed.

Figure 9:
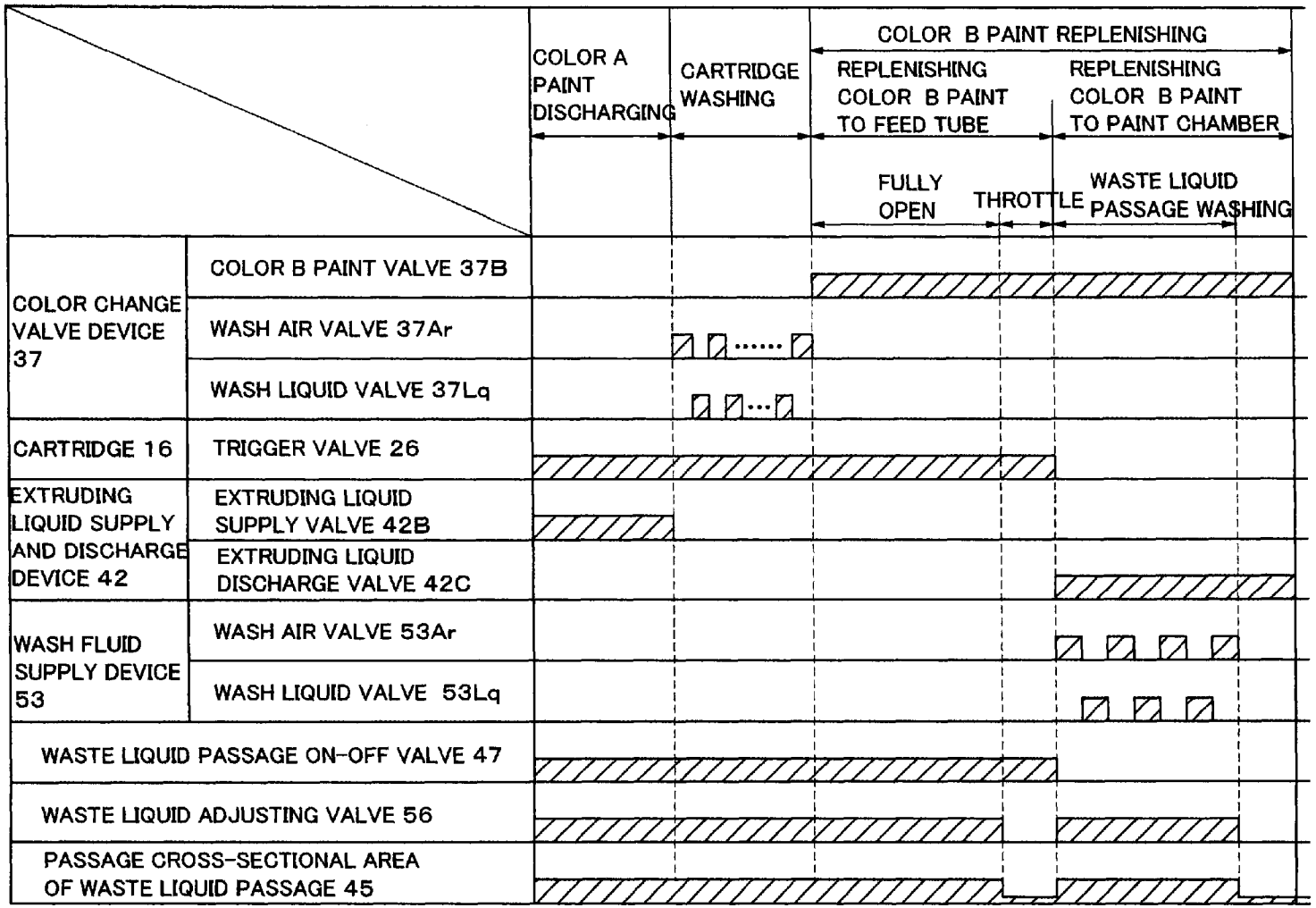
FIG. 9 is a time chart illustrating a paint replenishing method for replenishing paint by the paint replenishing apparatus for a cartridge.

The paint replenishing apparatus for a cartridge 31 in accordance with the first embodiment has the above-described configuration, and a paint replenishing method for the cartridge 16 by the paint replenishing apparatus for a cartridge 31 with reference to a time chart shown in FIG. 9 will be explained in greater details.

It should be noted that the paint replenishing method for a cartridge in accordance with the first embodiment will be explained by citing a case in which a color change is made from a paint of color A as a previous color paint which was used in a previous coating operation to a paint of color B as a next color paint which is used in a next coating operation as an example. Meanwhile, it will be explained under the assumption that the color A paint used in the previous coating operation remains in the paint chamber 19 of the cartridge 16 and the paint supply passage 21A of the feed tube 21, respectively.

Upon completion of a coating operation using the color A paint by the rotary atomizing head type coating apparatus 1, by moving the cartridge transfer device 205, the cartridge 16 is removed from the coater unit 6, and the cartridge 16 is mounted on the cartridge support member 32 of the paint replenishing apparatus for a cartridge 31. At this juncture, the quick joint 23 on the cartridge 16 side abuts against the female coupling portion 33A of the cartridge support member 32, while the quick joint 25 abuts against the female coupling portion 33B of the cartridge support member 32. As a result, the paint chamber 19 of the cartridge 16 communicates with the paint line 36 on the cartridge support member 32 side, and the extruding liquid chamber 20 communicates with the extruding liquid line 41. It should be noted that the color A paint which was used in the previous coating operation remains in the paint chamber 19 of the cartridge 16 and the paint supply passage 21A of the feed tube 21, respectively.

Next, the operation proceeds to a color A paint discharging step for discharging the remaining color A paint from the cartridge 16.

In the color A paint discharging step, the trigger valve 26 of the cartridge 16 is first opened. At the same time, the waste liquid passage on-off valve 47 of the paint replenishing apparatus for a cartridge 31 is set to the opening position (b), and the waste liquid adjusting valve 56 is set to the opening position (d), thereby allowing the paint chamber 19 and the waste liquid passage 45 to communicate with the waste liquid tank 46. In this state, the extruding liquid supply valve 42B of the extruding liquid supply and discharge device 42 is opened to thereby supply the extruding liquid inside the extruding liquid supply source 43 to the extruding liquid chamber 20 through the extruding liquid line 41, the quick joint 25, and the cartridge side extruding liquid passage 24.

In consequence, as shown in FIGS. 4 and 5, the piston 18 of the cartridge 16 is pushed by the extruding liquid until the volume of the paint chamber 19 becomes minimal. As a result, almost all of the color A paint remaining in the paint chamber 19 is discharged to the waste liquid tank 46 through the paint supply passage 21A of the feed tube 21, the waste liquid passage 45, the waste liquid passage on-off valve 47, and the waste liquid adjusting valve 56, thereby completing the operation concerning the color A paint discharging step.

Here, in the color A paint discharging step, at the time when the color A paint in the paint chamber 19 is discharged to the waste liquid tank 46 through the waste liquid passage 45, since the quick joint 23 is also in communication, it is conceivable that the color A paint in the paint chamber 19 possibly flows backwardly to the color change valve device 37 side through the paint line 36. However, since the color A paint at the time when it was replenished in the cartridge 16 remains in the paint line 36, and the paint valves 37A, 37B, . . . , 37N of the colors A, B, . . . , N, the wash air valve 37Ar, and the wash liquid valve 37Lq of the color change valve device 37 are respectively in the closed state, the color A paint which is extruded from the paint chamber 19 is discharged to the waste liquid tank 46 through the waste liquid passage 45 without flowing toward the paint line 36.

Next, upon completion of the color A paint discharging step, the operation proceeds to a cartridge washing step for washing off the color A paint remaining in the paint chamber 19 of the cartridge 16 and the paint supply passage 21A of the feed tube 21.

In the cartridge washing step, the extruding liquid supply valve 42B of the extruding liquid supply and discharge device 42 is first closed. Since this makes it impossible for the extruding liquid remaining in the extruding liquid passage 24 between the extruding liquid chamber 20 and the extruding liquid supply and discharge device 42 and in the extruding liquid line 41 to flow, the volume of the paint chamber 19 can be kept in a minimal state in the same way as when the color A paint discharging step is completed. At this time, the trigger valve 26, the waste liquid passage on-off valve 47, and the waste liquid adjusting valve 56 are in the opened state in the same way as in the color A paint discharging step.

Next, the opening and closing of the wash air valve 37Ar and the wash liquid valve 37Lq of the color change valve device 37 are alternately repeated to allow the wash air in the wash air source 40Ar and the wash liquid in the wash liquid source 40Lq to be alternately flowed through the paint chamber 19 and the paint supply passage 21A of the feed tube 21 through the paint line 36. In consequence, the color A paint remaining in the paint chamber 19 and the paint supply passage 21A is washed away by the wash air and the wash liquid, and is discharged toward the waste liquid tank 46, thereby completing the operation concerning the cartridge washing step.

Next, when the cartridge washing step is finished, the operation proceeds to a paint replenishing step for replenishing the color B paint into the paint chamber 19 and the paint supply passage 21A of the feed tube 21. The paint replenishing step will be described in order by dividing the step into a feed tube side paint replenishing step of replenishing the color B paint into the paint supply passage 21A of the feed tube 21 and a paint chamber side paint replenishing step of replenishing the color B paint into the paint chamber 19 of the cartridge 16.

First, in the feed tube side paint replenishing step, the trigger valve 26, the waste liquid passage on-off valve 47, and the waste liquid adjusting valve 56 are continued to be set in the opened state. At this time, the extruding liquid supply valve 42B and the extruding liquid discharge valve 42C of the extruding liquid supply and discharge device 42 are in the closed state, so that the volume of the paint chamber 19 of the cartridge 16 is in a minimal state in the same way as in the cartridge washing step.

Next, the color B paint valve 37B of the color change valve device 37 is opened to supply the color B paint stored in the paint supply source 39 toward the fore distal end of the feed tube 21 through the paint line 36, the quick joint 23 of the cartridge 16, and the paint chamber 19, to thereby replenish the color B paint into the paint supply passage 21A.

Here, paint undergoes a change in its viscosity in correspondence with its temperature change, as described before. For this reason, paint has the characteristic that when it flows through a conduit, even under the same supply pressure, its viscosity becomes low when the temperature of paint is high, and the discharge rate of paint increases, whereas when the temperature is low, the viscosity becomes high, and the discharge rate of paint decreases.

Accordingly, in the feed tube side paint replenishing step, it is necessary to constantly ensure that the paint is reliably replenished up to the fore distal end of the feed tube 21. For this reason, by assuming a case in which the viscosity of the paint is highest and the discharge rate is minimum, an arrival time when the color B paint reaches the fore distal end (discharge port) of the paint supply passage 21A of the feed tube 21 is set as a paint replenishing time on the feed tube 21 side (hereafter referred to as the paint replenishing time) in advance, in correspondence with this minimum discharge rate. However, when the viscosity of the paint is low, the discharge rate of the paint increases, so that a large amount of paint will be discharged and wastefully discarded even within the paint replenishing time.

Accordingly, in the feed tube side paint replenishing step, replenishing is carried out by dividing the step into a fully open replenishing step in which the color B paint is replenished by being supplied toward the paint supply passage 21A of the feed tube 21 at a large flow rate and a throttled replenishing step in which the color B paint is replenished by being supplied at a small flow rate.

First, in the fully open replenishing step, the waste liquid adjusting valve 56 is kept in the opening position (d) during the aforementioned paint replenishing time, and the color B paint is supplied and replenished into the paint supply passage 21A with the valve opening fully open. Upon completion of the fully open replenishing step, the operation continuously proceeds to the throttled replenishing step. In this throttled replenishing step, in order to increase pressure loss by decreasing the passage cross-sectional area of the waste liquid passage 45, the waste liquid adjusting valve 56 is set to the closing position (c) to allow only the throttle passages 62 to be open.

Here, the paint replenishing time is set in correspondence with a discharge rate of the paint which is in the state of a maximum viscosity yielding a minimum discharge rate. Accordingly, the color B paint when its viscosity is high is discharged by only a bare minimum amount from the discharge port of the paint supply passage 21A of the feed tube 21, so that the color B paint is not flowed through the throttle passages 62 in the throttled replenishing step.

Meanwhile, when the viscosity of the color B paint has declined and its discharge rate has increased, the color B paint flows beyond the discharge port of the paint supply passage 21A and reaches the throttle passages 62 of the waste liquid adjusting valve 56 during the paint replenishing time. At this time, however, the discharge rate of the color B paint decreases by being subjected to the action of the pressure loss due to the throttle passages 62. As a result, when the viscosity of the color B paint is low and the discharge rate has increased, it is possible to reduce the amount of the color B paint discharged wastefully from the feed tube 21. Thus, the feed tube side paint replenishing step of replenishing the color B paint into the paint supply passage 21A of the feed tube 21 ends.

Next, the operation proceeds to the paint chamber side paint replenishing step of replenishing the color B paint into the paint chamber 19. In the paint chamber side paint replenishing step, the trigger valve 26 is closed, and the extruding liquid discharge valve 42C of the extruding liquid supply and discharge device 42 is opened while keeping the open valve state for the color B paint valve 37B of the color change valve device 37. In consequence, the color B paint in the color B paint valve 37B is replenished into the paint chamber 19 of the cartridge 16 through the paint line 36, the cartridge side paint passage 22, and the like. At this time, the extruding liquid in an equivalent amount to that of the paint replenished into the paint chamber 19 is discharged from the extruding liquid chamber 20 toward the extruding liquid discharge line 44 through the extruding liquid discharge valve 42C.

Meanwhile, while the paint chamber side paint replenishing step is being executed, a waste liquid passage washing step is carried out in parallel with this paint chamber side paint replenishing step. Namely, in the waste liquid passage washing step, the color B paint remaining in the waste liquid passage 45, the waste liquid adjusting valve 56, and the like is discharged and washed off. For this reason, in the waste liquid passage washing step, after the waste liquid passage on-off valve 47 is set in the closing position (a) and the waste liquid adjusting valve 56 is set in the opening position (d), the wash air valve 53Ar and the wash liquid valve 53Lq of the wash fluid supply device 53 are alternately opened and closed. As a consequence, the wash air from the wash air source 55Ar and the wash liquid from the wash liquid source 55Lq are flowed through the waste liquid passage 45 and the waste liquid adjusting valve 56, and the waste wash liquid is discharged into the waste liquid tank 46.

As such, in accordance with the first embodiment, in the waste liquid passage 45 communicating with the feed tube insertion hole 34 of the cartridge support member 32, the waste liquid adjusting valve 56 is arranged to be provided by being located on the downstream side of the waste liquid passage on-off valve 47. When washing clean the paint chamber 19 of the cartridge 16 and the paint supply passage 21A of the feed tube 21, the waste liquid adjusting valve 56 is changed over to the opening position (d) to enlarge the passage cross-sectional area of the waste liquid passage 45. In consequence, the waste liquid passage 45 allows the wash fluids to be actively flowed, so that the color A paint remaining in the paint chamber 19 and the paint supply passage 21A can be effectively washed away in a short time.

Moreover, as for the waste liquid adjusting valve 56, the arrival time when the color B paint reaches the discharge port of the feed tube 21 after being supplied from the color change valve device 37 is set as the paint replenishing time for the feed tube, and this paint replenishing time for the feed tube 21 is set by such conditions as the viscosity of the paint and the length dimension and inside diameter dimension of the supply passage. Accordingly, when the paint replenishing time has been reached, the waste liquid adjusting valve 56 is changed over to the closing position (c) to allow the paint to be flowed only by the throttle passages 62. In consequence, the waste liquid adjusting valve 56 is throttled such that the passage cross-sectional area of the waste liquid passage 45 becomes small, thereby making it possible to reduce the amount of paint discharged from the discharge port of the feed tube 21.

As a result, in the cartridge side paint replenishing step of replenishing the color B paint into the cartridge 16, even in cases where the paint replenishing time varies due to various conditions, the waste liquid adjusting valve 56 is able to narrowly throttle the passage cross-sectional area of the waste liquid passage 45 after the lapse of the paint replenishing time. Therefore, it is possible to reduce the amount of paint which would otherwise be discharged wastefully from the discharge port of the feed tube 21, thereby making it possible to decrease the amount of paint discarded when the color B paint is replenished.

In this instance, when the color B paint is replenished into the paint supply passage 21A of the feed tube 21, the waste liquid adjusting valve 56 widely enlarges the passage cross-sectional area of the waste liquid passage 45 in the fully open replenishing step from the start until before the end of the cartridge side paint replenishing step, and uses only the throttle passages 62 as flow passages in the throttled replenishing step to narrowly throttle before the end of the passage cross-sectional area of the waste liquid passage 45. As a consequence, in the fully open replenishing step, the color B paint can be speedily replenished into the paint supply passage 21A of the feed tube 21, and the replenishing time can thereby be shortened. Meanwhile, in the throttled replenishing step, the passage cross-sectional area is made small, making it possible to reduce the discharge rate of the color B paint which is discarded from the discharge port of the feed tube 21.

Further, the waste liquid adjusting valve 56 is provided with the recessed groove-shaped throttle passages 62 on the inner peripheral surface 58A of the valve seat 58. In consequence, the waste liquid adjusting valve 56 is able to control the valve body 60 between two positions, namely, the opening position (d) and the closing position (c), so that the mechanism can be simplified. Moreover, when the waste liquid adjusting valve 56 is set in the closing position (d), the passage cross-sectional area of the waste liquid passage 45 can be throttled by the throttle passages 62 so as to become fixed each time.

Furthermore, in the paint replenishing method for a cartridge in accordance with the first embodiment, the waste liquid passage washing step for washing the waste liquid passage 45 is provided during the color B paint replenishing step for replenishing paint into the paint chamber 19, the two steps can be performed in parallel, thereby making it possible to improve the operational efficiency, productivity, and the like.

Figure 10:
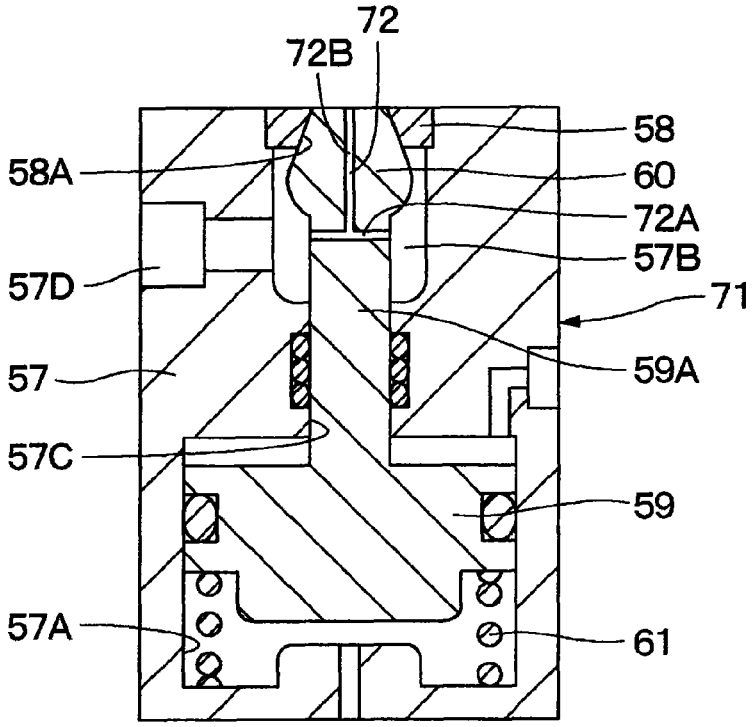
FIG. 10 is a longitudinal cross-sectional view illustrating the waste liquid adjusting valve in accordance with a second embodiment.

Next, FIG. 10 shows a second embodiment of the present invention. The characteristic of the second embodiment lies in a construction in which the valve body of the waste liquid adjusting valve is provided with a throttle passage. It should be noted that, in the second embodiment, those component elements that are identical to those of the above-described first embodiment will be simply denoted by the same reference numerals to avoid repetitions of similar explanations.

In FIG. 10, indicated at 71 is a waste liquid adjusting valve in accordance with the second embodiment, and this waste liquid adjusting valve 71 is formed as a two-way and two-position air-driven type on-off valve in substantially the same way as the waste liquid adjusting valve 56 in accordance with the first embodiment. A throttle passage 72 is provided in the valve body 60 of this waste liquid adjusting valve 71. This throttle passage 72 is formed into a T-shape by a transversal passage 72A which extends diametrically penetrating the valve body 60 by being located on the proximal end side of the valve body 60 in the valve chamber 57B and by a longitudinal passage 72B which extends in the axial direction of the valve inside the valve body 60, whose proximal end side communicates with the transversal passage 72A, and whose distal end side is open to a distal end face of the valve body 60.

According to the second embodiment thus constructed, when the valve body 60 is opened, the waste liquid passage 45 is widely opened, making it possible to speedily replenish paint into the paint supply passage 21A of the feed tube 21 of the cartridge 16. Meanwhile, when the valve body 60 is closed, paint is discharged from the transversal passage 72A of the throttle passage 72 through the longitudinal passage 72B thereof, thereby making it possible to reduce the paint which is discarded in the feed tube side paint replenishing step.

Figure 11:
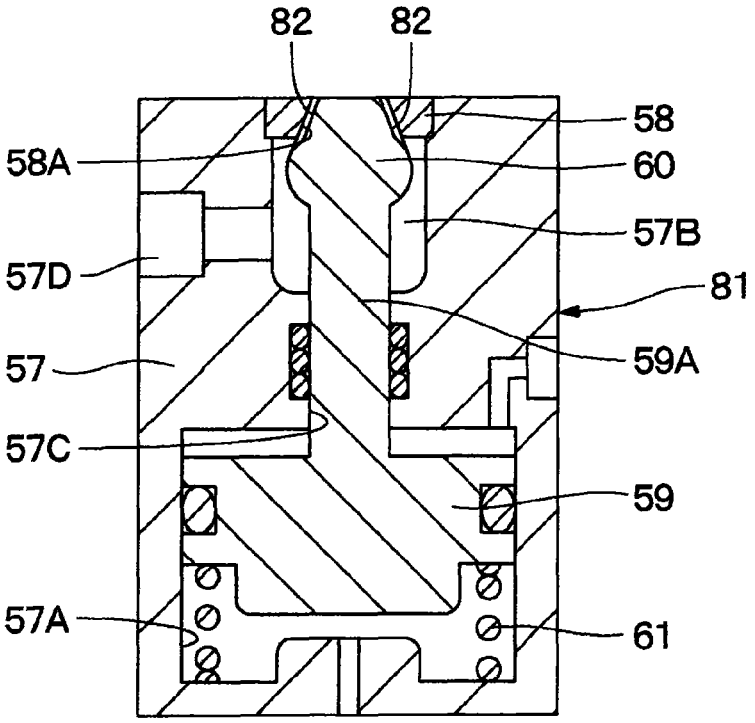
FIG. 11 is a longitudinal cross-sectional view illustrating the waste liquid adjusting valve in accordance with a third embodiment.

Next, FIG. 11 shows a third embodiment of the present invention. The characteristic of the third embodiment lies in a construction in which a recessed groove-shaped throttle passage is provided on the outer peripheral surface of the valve body of the waste liquid adjusting valve. It should be noted that, in the third embodiment, those component elements that are identical to those of the above-described first embodiment will be simply denoted by the same reference numerals to avoid repetitions of similar explanations.

In FIG. 11, indicated at 81 is a waste liquid adjusting valve in accordance with the third embodiment, and this waste liquid adjusting valve 81 is formed as a two-way and two-position air-driven type on-off valve in substantially the same way as the waste liquid adjusting valve 56 in accordance with the first embodiment. A throttle passage 82 is provided on the valve body 60 of this waste liquid adjusting valve 81. This throttle passage 82 is formed as one or a plurality of longitudinal recessed grooves extending in the axial direction by being located on the outer peripheral surface of the valve body 60. It should be noted that although, in FIG. 11, two throttle passages 82 are shown, one or three or more throttle passages 82 may be used.

According to the third embodiment thus constructed, when the valve body 60 is opened, the waste liquid passage 45 is widely opened, making it possible to speedily replenish paint into the interior of the feed tube 21 of the cartridge 16. Meanwhile, when the valve body 60 is closed, paint is discharged through the longitudinal recessed groove-shaped throttle passages 82, thereby making it possible to reduce the paint which is discarded in the feed tube side paint replenishing step.

Figure 12:
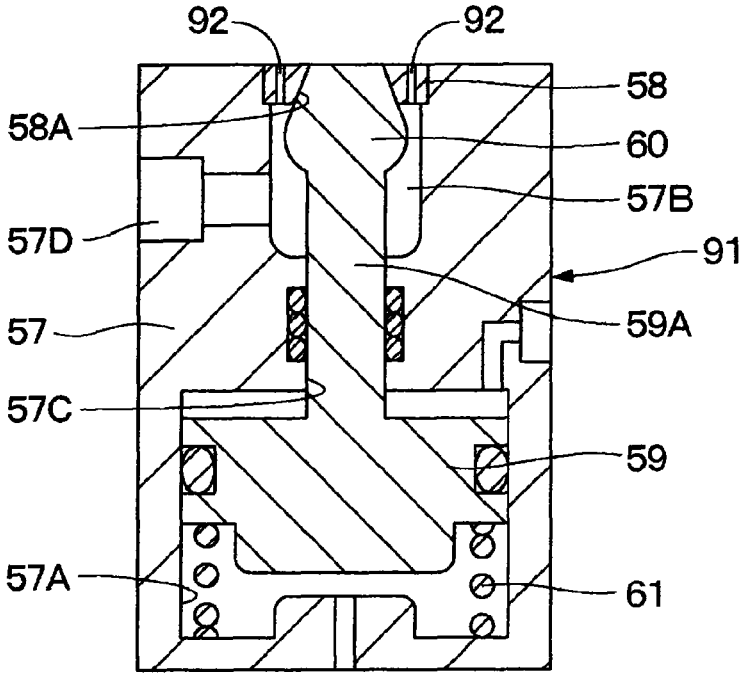
FIG. 12 is a longitudinal cross-sectional view illustrating the waste liquid adjusting valve in accordance with a fourth embodiment.

Next, FIG. 12 shows a fourth embodiment of the present invention. The characteristic of the fourth embodiment lies in a construction in which throttle passages are provided by axially penetrating the valve seat of the waste liquid adjusting valve. It should be noted that, in the fourth embodiment, those component elements that are identical to those of the above-described first embodiment will be simply denoted by the same reference numerals to avoid repetitions of similar explanations.

In FIG. 12, indicated at 91 is a waste liquid adjusting valve in accordance with the fourth embodiment, and this waste liquid adjusting valve 91 is formed as a two-way and two-position air-driven type on-off valve in substantially the same way as the waste liquid adjusting valve 56 in accordance with the first embodiment. A throttle passage 92 is provided in the valve seat 58 of this waste liquid adjusting valve 91. This throttle passage 92 is formed as one or a plurality of through holes penetrating the valve seat 58 in the axial direction by being located on the outer peripheral side of the valve seat 58. It should be noted that although, in FIG. 12, two throttle passages 92 are shown, one or three or more throttle passages 92 may be used.

According to the fourth embodiment thus constructed, when the valve body 60 is opened, the waste liquid passage 45 is widely opened, making it possible to speedily replenish paint into the paint supply passage 21A of the feed tube 21 of the cartridge 16. Meanwhile, when the valve body 60 is closed, paint is discharged through the throttle passage 92 penetrating the valve seat 58, thereby making it possible to reduce the paint which is discarded in the feed tube side paint replenishing step. In particular, in the fourth embodiment, since the throttle passage 92 is provided in the valve seat 58 which is a part of the valve casing 57, special processing with respect to the valve body 60 is unrequired.

Figure 13:
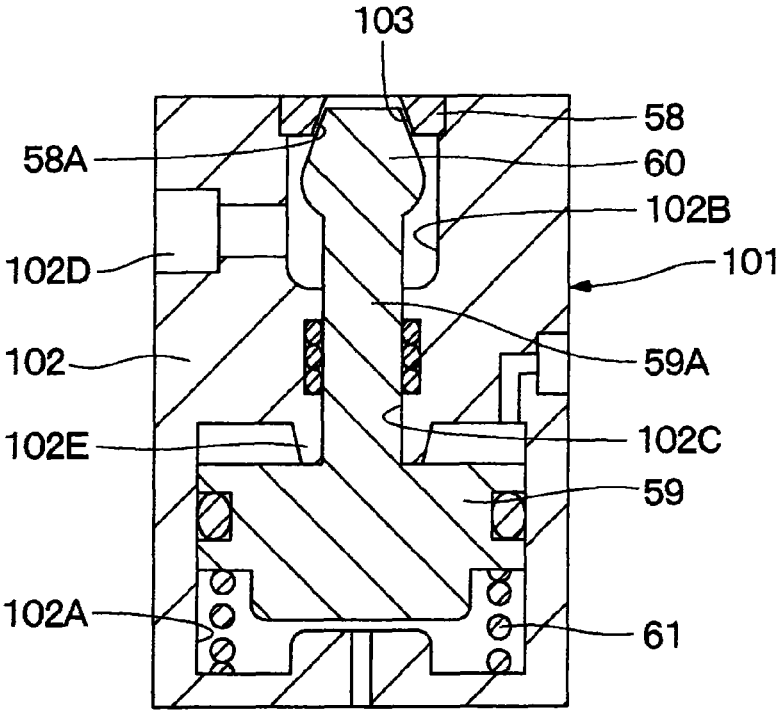
FIG. 13 is a longitudinal cross-sectional view illustrating the waste liquid adjusting valve in accordance with a fifth embodiment.

Next, FIG. 13 shows a fifth embodiment of the present invention. The characteristic of the fifth embodiment lies in a construction in which the valve casing of the waste liquid adjusting valve is provided with a stopper for holding the valve body in a proximate position which is proximate to the valve seat to thereby form a throttle passage between the valve seat and the valve body so as to allow paint to flow with a small passage cross-sectional area. It should be noted that, in the fifth embodiment, those component elements that are identical to those of the above-described first embodiment will be simply denoted by the same reference numerals to avoid repetitions of similar explanations.

In FIG. 13, indicated at 101 is a waste liquid adjusting valve in accordance with the fifth embodiment, and this waste liquid adjusting valve 101 is formed as a two-way and two-position air-driven type on-off valve in substantially the same way as the waste liquid adjusting valve 56 in accordance with the first embodiment. In substantially the same way as the valve casing 57 in accordance with the above-described first embodiment, a valve casing 102 in accordance with the fifth embodiment has a piston chamber 102A, a valve chamber 102B, a valve stem insertion hole 102C, and an outlet port 102D. However, the valve casing 102 in accordance with the fifth embodiment differs from the valve casing 57 in accordance with the first embodiment in that a hollow cylindrical stopper 102E projecting toward the piston 59 is provided in the piston chamber 102A.

Here, when the valve body 60 is displaced in the closing direction by the urging force of the valve spring 61 by restricting the displacement of the piston 59 in the closing direction, the stopper 102E is adapted to hold the valve body 60 in the proximate position which is proximate to the valve seat 58. As a consequence, a throttle passage 103 constituted by an annular gap and having a small passage cross-sectional area can be formed between the valve body 60 and the valve seat 58.

According to the fifth embodiment thus constructed, when the valve body 60 is opened, the waste liquid passage 45 is widely opened, making it possible to speedily replenish paint into the paint supply passage 21A of the feed tube 21 of the cartridge 16. Meanwhile, when the valve body 60 is displaced in the closing direction, the displacement of the valve body 60 is restricted to the position proximate to the valve seat 58 by the stopper 102E. In consequence, as the paint is discharged through the throttle passage 103 constituted by the gap between the valve seat 58 and the valve body 60, it is possible to reduce the paint which is discarded in the feed tube side paint replenishing step. In particular, in the fifth embodiment, since the valve casing 102 is provided with the stopper 102E, special processing with respect to the valve body 60 is unrequired.

Figure 14:
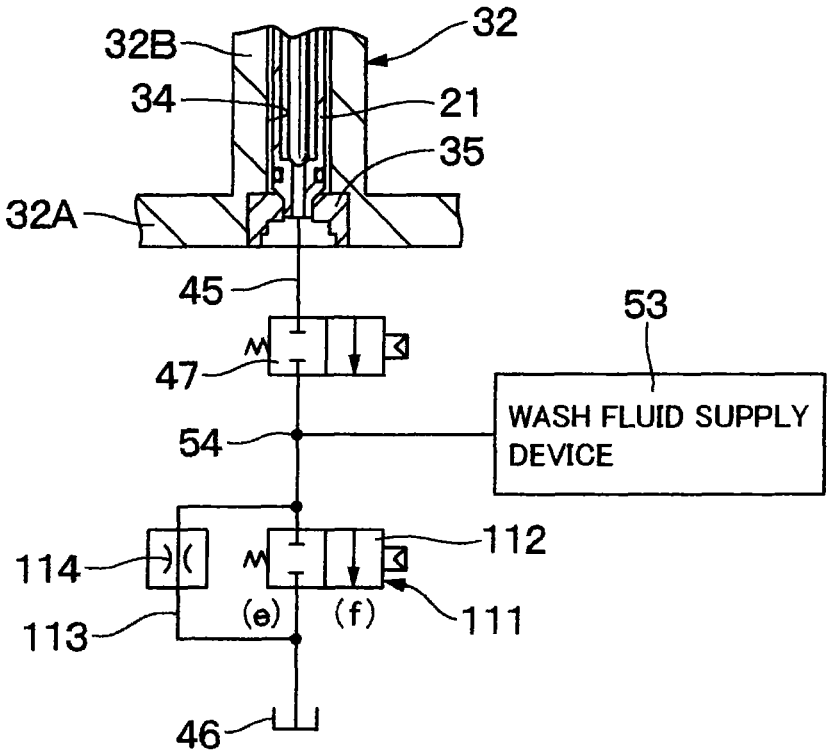
FIG. 14 is a longitudinal cross-sectional view illustrating the waste liquid adjusting valve in accordance with a sixth embodiment.

Next, FIG. 14 shows a sixth embodiment of the present invention. The characteristic of the sixth embodiment lies in that the waste liquid adjusting valve is constituted by an on-off valve and a throttle passage which are provided separately. It should be noted that, in the sixth embodiment, those component elements that are identical to those of the above-described first embodiment will be simply denoted by the same reference numerals to avoid repetitions of similar explanations.

In FIG. 14, indicated at 111 is a waste liquid adjusting valve in accordance with the sixth embodiment. This waste liquid adjusting valve 111 is constituted by a two-way and two-position air-driven type on-off valve 112 provided in the course of the waste liquid passage 45, a bypass passage 113 connected to the waste liquid passage 45 by bypassing the on-off valve 112, and a throttle passage 114 provided in the bypass passage 113.

According to the sixth embodiment thus constructed, when the on-off valve 112 is set in an opening position (f), the waste liquid passage 45 is widely opened, making it possible to speedily replenish paint into the paint supply passage 21A of the feed tube 21 of the cartridge 16. Meanwhile, when the on-off valve 112 is set in a closing position (e), paint is discharged through the throttle passage 114 through the bypass passage 113, so that it is possible to reduce the paint which is discarded in the feed tube side paint replenishing step. Moreover, as the on-off valve 112 is separated from the throttle passage 114, an inexpensive two-way and two-position air-driven type on-off valve of standard specifications can be used as the on-off valve 112 of the waste liquid adjusting valve 111.

Figure 15:
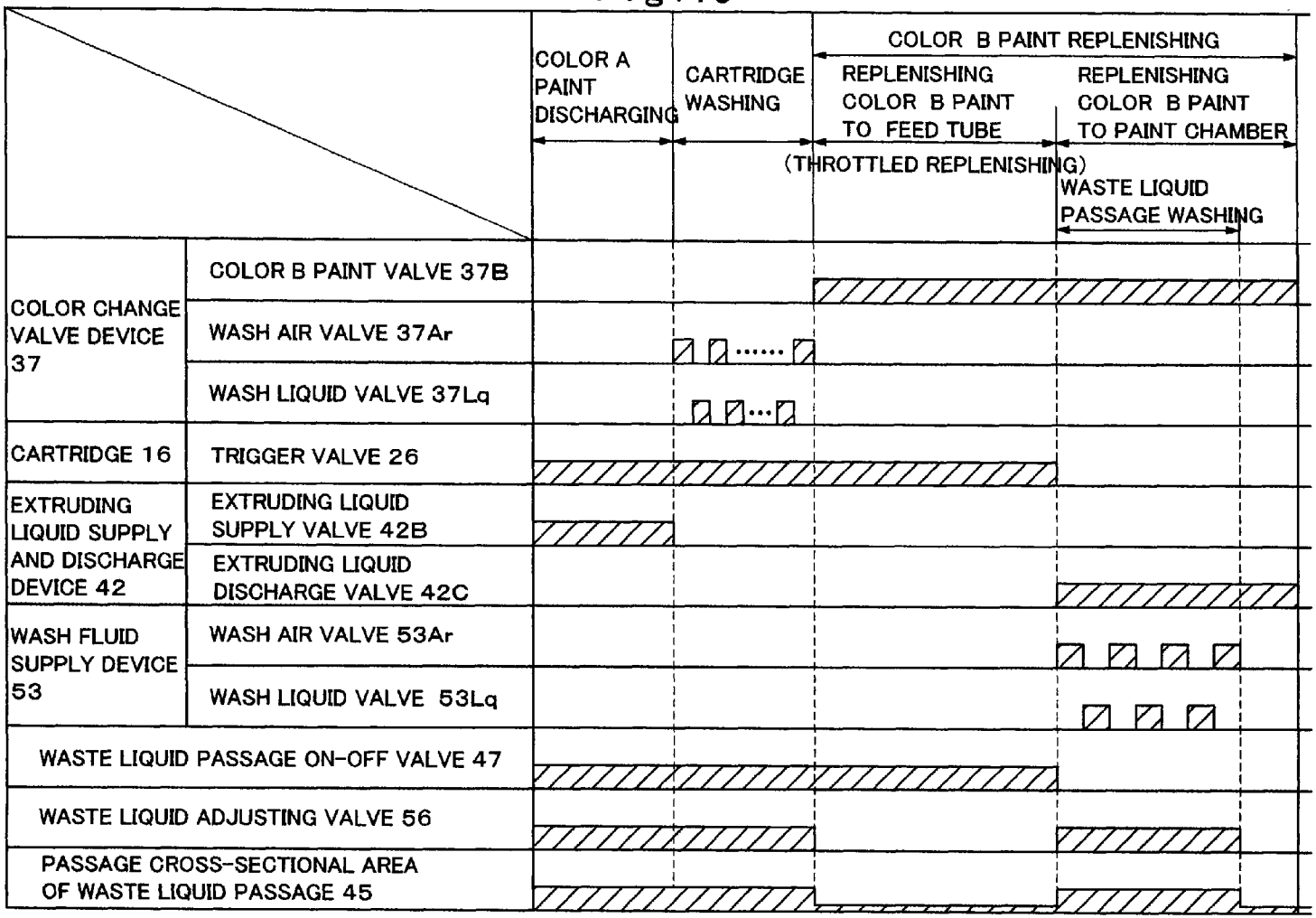
FIG. 15 is a time chart illustrating the paint replenishing method for a cartridge in accordance with a seventh embodiment.

Next, FIG. 15 shows a seventh embodiment of the present invention. The characteristic of the seventh embodiment lies in a construction in which, in the feed tube side paint replenishing step, the time when the paint in such a state that its viscosity is lowest and hence its discharge rate is maximum reaches the fore distal end of the feed tube is set as the paint replenishing time, and the waste liquid adjusting valve is throttled through the entire step from the start until the end of replenishing of paint into the paint supply passage of the feed tube such that the passage cross-sectional area of the waste liquid passage becomes small. It should be noted that, in the seventh embodiment, those component elements that are identical to those of the above-described first embodiment will be simply denoted by the same reference numerals to avoid repetitions of similar explanations.

Namely, as in the time chart shown in FIG. 15, the waste liquid adjusting valve 56 is set in the closing position (c) upon completion of the cartridge washing step, and keeps its closing position (c) in the feed tube side paint replenishing step as well. Accordingly, in the feed tube side paint replenishing step, the waste liquid adjusting valve 56 is continuously closed through the entire step from the start until the end of replenishing, and is thereby throttled such that the passage cross-sectional area of the waste liquid passage 45 becomes small. As a result, in the seventh embodiment, there is no distinction between the feed tube side paint replenishing step and the throttled replenishing step, and both steps are provided with an identical step of operation.

According to the seventh embodiment thus constructed, in the color A paint discharging step and the cartridge washing step, since the waste liquid adjusting valve 56 is opened, the waste liquid passage 45 can be widely opened to allow discarded paint and wash fluids to be smoothly flowed. In the feed tube side paint replenishing step, on the other hand, since the waste liquid adjusting valve 56 is closed through the entire step, the amount of paint which is wastefully discharged can be made further small although the time for replenishing paint into the paint supply passage 21A of the feed tube 21 becomes slightly longer. It should be noted that although the waste liquid adjusting valve 56 is used in the seventh embodiment, it is possible to alternatively use other waste liquid adjusting valves 71, 81, 91, 101, and 111.

Figure 16:
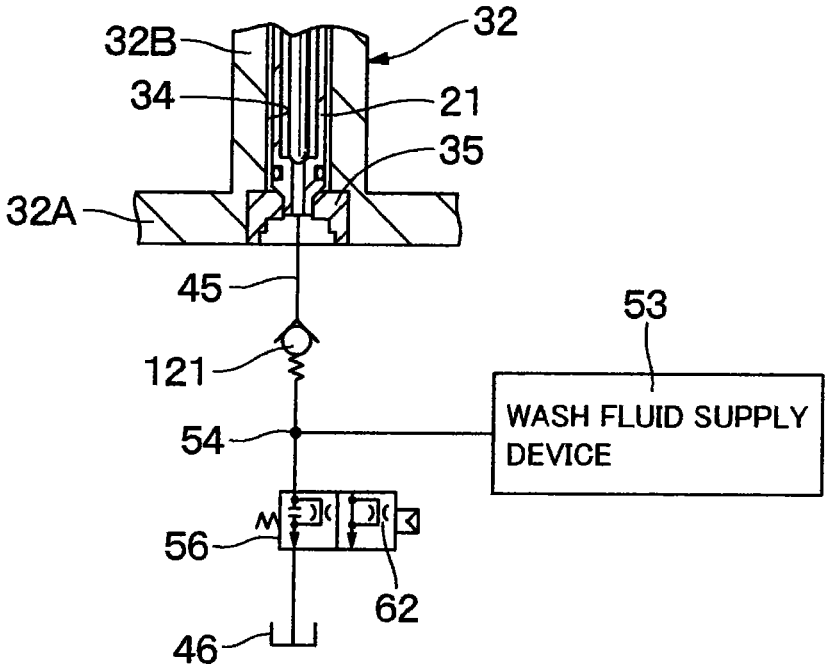
FIG. 16 is a circuit diagram illustrating the waste liquid passage on-off valve in accordance with a modification.

It should be noted that, in the first embodiment, it is explained by citing as an example the case in which the waste liquid passage on-off valve 47 constituted by a two-way and two-position air-driven type on-off valve is provided in the waste liquid passage 45. However, the present invention is not limited to the same, and may be configured as in the modification shown in FIG. 16, for example. Namely, a waste liquid passage on-off valve 121 may be constituted by a check valve which allows paint to flow out from the feed tube 21 and prevents its backward flow. This configuration can be similarly applied to other embodiments as well.

Further, in each of the embodiments, it is explained by citing as an example of, as the coating apparatus, the rotary atomizing head type coating apparatus 1 equipped with the rotary atomizing head 9. However, the present invention is not limited to the same, and may be so configured that, for example, a coating apparatus equipped with an air atomizing nozzle, a hydraulic atomizing nozzle, or the like is used as the coating apparatus.

DESCRIPTION OF REFERENCE NUMERALS

1: Rotary atomizing head type coating apparatus (Coating apparatus)
6: Coater unit
16: Cartridge
17: Tank
18: Piston (Partition wall)
19: Paint chamber
20: Extruding liquid chamber
21: Feed tube
21A: Paint supply passage
26: Trigger valve
31: Paint replenishing apparatus for a cartridge
32: Cartridge support member
33: Tank support portion
34: Feed tube insertion hole
36: Paint line
37: Color change valve device
37A, 37B, . . . , 37N: Paint valves of colors A, B, . . . , N
37Ar: Wash air valve
37Lq: Wash liquid valve
39: Paint supply source
40Ar: Wash air source
40Lq: Wash liquid source
41: Extruding liquid line
42: Extruding liquid supply and discharge device
45: Waste liquid passage
46: Waste liquid tank
47: Waste liquid passage on-off valve
53: Wash fluid supply device
56, 71, 81, 91, 101, 111: Waste liquid adjusting valve
57, 102: Valve casing
58: Valve seat
59: Piston
60: Valve body
62, 72, 82, 92, 103, 114: Throttle passage
102E: Stopper
121: Waste liquid passage on-off valve (Check valve)

The invention claimed is:

1. A paint replenishing apparatus for a cartridge comprising:

a cartridge for storing paint to be supplied to a coating apparatus, including a tank, a feed tube whose proximal end side is mounted on said tank and whose fore distal end side extends in an axial direction from said tank, a partition wall provided movably in said tank and that partitions an interior of said tank into a paint chamber into which paint is replenished and an extruding liquid chamber to and from which an extruding liquid is supplied and discharged, and a trigger valve for opening and closing a paint supply passage in said feed tube at a fore distal end portion of said feed tube;

a cartridge support member in which a feed tube insertion hole for insertion of said feed tube therethrough is provided so as to extend in the axial direction, and in which a tank support portion for supporting said tank of said cartridge is provided on a side of an insertion port of said feed tube insertion hole;

a color change valve device provided connected to said cartridge support member, and which supplies a paint selected from among paints of a plurality of colors into said paint chamber of said cartridge and said paint supply passage of said feed tube at a time of replenishment of paint, and supplies a wash fluid into said paint supply passage of said feed tube through said paint chamber at a time of washing off of remaining paint;

an extruding liquid supply and discharge device provided connected to said cartridge support member, and which supplies the extruding liquid toward said extruding liquid chamber of said cartridge at the time of said washing and discharges the extruding liquid from said extruding liquid chamber at the time of the replenishment of paint;

a waste liquid passage having one end side provided in communication with said feed tube insertion hole by being located on a bottom side of said feed tube insertion hole of said cartridge support member and another end side communicating with a waste liquid tank;

a waste liquid passage on-off valve provided in said waste liquid passage to open and close said waste liquid passage;

a wash fluid supply device connected to said waste liquid passage and located on an outlet side of said waste liquid passage on-off valve and that supplies a wash fluid for washing clean said waste liquid passage; and a waste liquid adjusting valve provided in said waste liquid passage by being located on a downstream side of said waste liquid passage on-off valve;

wherein said waste liquid adjusting valve includes a throttle passage, and wherein said waste liquid adjusting valve is configured to widely enlarge a passage cross-sectional area of said waste liquid passage at the time of washing clean said paint chamber and said paint supply passage of said feed tube, and is configured to narrowly throttle the passage cross-sectional area of said waste liquid passage at the time of replenishing paint into said paint supply passage of said feed tube to allow paint to flow into said waste liquid passage by said throttle passage.

2. The paint replenishing apparatus for a cartridge according to claim 1, wherein, at a time of replenishing a next color paint into said paint supply passage of said feed tube, said waste liquid adjusting valve is configured to be opened in a state in which the passage cross-sectional area of said waste liquid passage is widely enlarged in advance, and is configured to narrowly throttle the passage cross-sectional area of said waste liquid passage prior to completion of replenishing.

3. The paint replenishing apparatus for a cartridge according to claim 1, wherein, at a time of replenishing a next color paint into said paint supply passage of said feed tube, said waste liquid adjusting valve is configured to narrowly throttle the passage cross-sectional area of said waste liquid passage continuously from a start to an end of replenishing.

4. The paint replenishing apparatus for a cartridge according to claim 1, wherein said waste liquid adjusting valve includes a valve casing including a valve seat in said waste liquid passage and a valve body seated on and unseated from said valve seat, and said throttle passage is configured to allow paint to flow therethrough with a small passage cross-sectional area in a closing position in which said valve body abuts against said valve seat.

5. The paint replenishing apparatus for a cartridge according to claim 1, wherein said waste liquid adjusting valve includes a valve casing including a valve seat in said waste liquid passage and a valve body seated on and unseated from said valve seat, and said throttle passage is configured to allow paint to be flowed therethrough with a small passage cross-sectional area between said valve seat and said valve body by providing a stopper formed on said valve casing and holding said valve body in a proximate position which is proximate to said valve seat.

6. A paint replenishing method for a cartridge for replenishing paint to be supplied to a coating apparatus into a cartridge that includes a tank into which the paint is replenished, a feed tube whose proximal end side is mounted on said tank and whose fore distal end side extends in an axial direction from said tank, a partition wall provided movably in said tank and that partitions an interior of said tank into a paint chamber and an extruding liquid chamber, and a trigger valve for opening and closing a paint supply passage in said feed tube at a fore distal end portion of said feed tube, said paint replenishing method for a cartridge comprising:

a previous color paint discharging step of discharging a previous color paint remaining in said paint chamber of said cartridge to a side of a waste liquid passage connected to a discharge side of said feed tube;

a cartridge washing step of washing off the previous color paint attached to said paint chamber of said cartridge and said paint supply passage of said feed tube;

a feed tube side paint replenishing step of replenishing a next color paint in a state in which a discharge rate of the paint from said paint supply passage is decreased by narrowly regulating a passage cross-sectional area of said waste liquid passage and allowing paint to flow into said waste liquid passage by said throttle passage when the next color paint is replenished into said paint supply passage of said feed tube; and a paint chamber side paint replenishing step of replenishing the next color paint into said paint chamber of said cartridge in a state in which said waste liquid passage is closed upon completion of replenishing of the next color paint into said paint supply passage of said feed tube.

7. The paint replenishing method for a cartridge according to claim 6, wherein, in said feed tube side paint replenishing step, the next color paint is arranged to be replenished in a state in which the discharge rate of the paint from said paint supply passage is increased by widely regulating the passage cross-sectional area of said waste liquid passage in advance, and prior to completion of replenishing the discharge rate of the paint from said paint supply passage is decreased by narrowly regulating the passage cross-sectional area of the waste liquid passage.

8. The paint replenishing method for a cartridge according to claim 6, wherein, in said feed tube side paint replenishing step, the passage cross-sectional area of said waste liquid passage is arranged to be narrowly throttled through an entire step of replenishing paint into said paint supply passage of said feed tube.

9. The paint replenishing method for a cartridge according to claim 6, further comprising a waste liquid passage washing step of washing clean said waste liquid passage while said paint chamber side paint replenishing step is being executed.

10. The paint replenishing method for a cartridge according to claim 7, further comprising a waste liquid passage washing step of washing clean said waste liquid passage while said paint chamber side paint replenishing step is being executed.

11. The paint replenishing method for a cartridge according to claim 8, further comprising a waste liquid passage washing step of washing clean said waste liquid passage while said paint chamber side paint replenishing step is being executed.

* * * * *